US009248486B2

(12) United States Patent
Abe et al.

(10) Patent No.: US 9,248,486 B2
(45) Date of Patent: Feb. 2, 2016

(54) ROLLER LEVELER

(71) Applicant: JP STEEL PLANTECH CO., Yokohama, Kanagawa (JP)

(72) Inventors: Keizo Abe, Kanagawa (JP); Toru Aoyama, Kanagawa (JP); Yutaka Kusanagi, Kanagawa (JP); Nobumasa Okazaki, Kanagawa (JP)

(73) Assignee: JP Steel Plantech Co. (JP)

( * ) Notice: Subject to any disclaimer, the term of this patent is extended or adjusted under 35 U.S.C. 154(b) by 0 days.

(21) Appl. No.: 14/612,764

(22) Filed: Feb. 3, 2015

(65) Prior Publication Data

US 2015/0143864 A1 May 28, 2015

Related U.S. Application Data

(63) Continuation of application No. 13/143,502, filed as application No. PCT/JP2010/003951 on Jun. 15, 2010, now abandoned.

(30) Foreign Application Priority Data

Jan. 29, 2010 (JP) ..... 2010-017988
Jan. 29, 2010 (JP) ..... 2010-017989

(51) Int. Cl.
*B21D 1/02* (2006.01)
*B21D 1/05* (2006.01)
*B21B 31/10* (2006.01)

(52) U.S. Cl.
CPC . *B21D 1/02* (2013.01); *B21B 31/10* (2013.01); *B21B 31/106* (2013.01); *B21D 1/05* (2013.01)

(58) Field of Classification Search
CPC ..... B21D 1/00; B21D 1/02; B21D 1/05; B21B 31/10; B21B 31/103; B21B 31/106; B21B 31/12; B21B 31/16; B21B 31/18; B21B 31/185; B21B 31/20; B21B 31/32; B21B 1/22; B21B 37/62; B21B 2031/021; B21B 2031/023; B21B 2031/025; B21B 2031/026
USPC ..... 72/160, 163, 164, 165, 245
See application file for complete search history.

(56) References Cited

U.S. PATENT DOCUMENTS 3,442,108 A 5/1969 Muller
3,559,441 A 2/1971 Lemper
(Continued)

FOREIGN PATENT DOCUMENTS

DE 2124706 A1 2/1972
FR 2718661 A1 10/1995
(Continued)

OTHER PUBLICATIONS

Extended European Search Report for Application No. EP 10 84 4524 dated Mar. 17, 2015 (6 pages).
(Continued)

*Primary Examiner* — Alexander P Taousakis
*Assistant Examiner* — Gregory Swiatocha
(74) *Attorney, Agent, or Firm* — Harness, Dickey & Pierce, P.L.C.

(57) ABSTRACT

A roller leveler is provided having a substantially uniform pitch of leveling rolls arranged in a zigzag manner. The roller leveler has a first roll group with first leveling rolls at a pitch "P1", a second roll group with second leveling rolls at the pitch "P1", a first retract mechanism for retracting the middle first leveling rolls, and second retract mechanisms for retracting pairs of end second leveling rolls. The second roll group also has third leveling rolls at the pitch "P1" with respect to the outermost second leveling rolls.

4 Claims, 23 Drawing Sheets

(56) References Cited

U.S. PATENT DOCUMENTS

| | | | | | |
|---|---|---|---|---|---|
| 3,648,505 | A * | 3/1972 | Eibe | B21D 3/05 | 72/165 |
| 3,657,913 | A * | 4/1972 | Talbot | B21B 13/14 | 100/162 B |
| 4,313,322 | A * | 2/1982 | Malinowski | B21D 1/02 | 72/164 |
| 4,454,738 | A * | 6/1984 | Buta | B21D 1/02 | 72/10.1 |
| 4,651,549 | A | 3/1987 | Masui | | |
| 4,730,472 | A * | 3/1988 | Ellis | B21B 13/14 | 72/10.1 |
| 5,127,250 | A * | 7/1992 | Nagata | B21D 1/02 | 72/163 |
| 5,412,968 | A * | 5/1995 | Benz | B21D 1/02 | 72/164 |
| 5,680,785 | A | 10/1997 | Quehen et al. | | |
| 5,758,533 | A * | 6/1998 | Quehen | B21D 1/02 | 72/163 |
| 7,637,132 | B2 | 12/2009 | Vasta et al. | | |
| 9,126,250 | B2 * | 9/2015 | Chazal | B21D 1/02 | |
| 2008/0011036 | A1 | 1/2008 | Buta | | |

FOREIGN PATENT DOCUMENTS

| | | | |
|---|---|---|---|
| JP | 62-199220 | A | 9/1987 |
| JP | 62-203616 | A | 9/1987 |
| JP | S62-214825 | A | 9/1987 |
| JP | 01-113122 | | 5/1989 |
| JP | 05-057350 | | 3/1993 |
| JP | 6-28765 | B2 | 4/1994 |
| JP | 2006-255712 | A | 9/2006 |

OTHER PUBLICATIONS

Chinese Office Action for Application No. 201010290710.4 mailed Feb. 27, 2013 (6 pages).

Japanese Office Action for Application No. 2010-017989 dated Aug. 16, 2013 with English translation (4 pages).

* cited by examiner

ROLLER LEVELER

CROSS-REFERENCE TO RELATED APPLICATION

This application is a continuation of U.S. patent application Ser. No. 13/143,502, filed Jul. 6, 2011, which is a U.S. National Stage Application of International Application No. PCT/JP2010/003951, filed on Jun. 15, 2010, which claims priority to Japanese Application No. 2010-017988, filed on Jan. 29, 2010 and Japanese Application No. 2010-017989, filed on Jan. 29, 2010, all of which are hereby expressly incorporated by reference herein in their entireties.

TECHNICAL FIELD

The present invention relates to a roller leveler for flattening warping or bending of a steel plate which is rolled by a rolling mill.

BACKGROUND

Conventionally, a roller leveler has been widely utilized in which a steel plate rolled by a rolling mill is flattened while being carried. A roller leveler in this type has been known which is capable of flattening both of a thick steel plate and a thin steel plate whose thicknesses are different from each other by changing a pitch of leveling rolls which are used for flattening the steel plate (see, for example, Japanese Patent Laid-Open No. Hei 5-57350 and Japanese Patent Laid-Open No. Sho 62-203616).

The roller leveler described in Hei 5-57350 and Sho 62-203616 is provided with six pieces of upper leveling rolls, which are arranged in a constant pitch on an upper side of a pass line where a steel plate is passed, and seven pieces of lower leveling rolls which are arranged in the same pitch as the upper leveling rolls on a lower side of the pass line. The upper leveling rolls and the lower leveling rolls in the roller leveler are arranged in a zigzag manner so as to sandwich the pass line, and a pitch between the upper leveling rolls and the lower leveling rolls in a carrying direction of the steel plate is set to be a half of the pitch of the upper leveling rolls. Further, the roller leveler is provided with a retract mechanism by which three upper leveling rolls disposed at every other rolls of the six upper leveling rolls are moved upward to retract from the pass line, a retract mechanism by which three lower leveling rolls disposed at every other rolls of the seven lower leveling rolls are moved downward to retract from the pass line, and a moving mechanism by which the seven lower leveling rolls are moved to an upstream side or a downstream side in the carrying direction of the steel plate.

In the roller leveler described above, a pitch of the leveling rolls which are used for flattening a steel plate is changed as follows. In other words, in the roller leveler, first, three of the six pieces of the upper leveling rolls are moved upward to retract from the pass line and three of the seven pieces of the lower leveling rolls are moved downward to retract from the pass line by the retract mechanism. In this state, a pitch in the carrying direction between the upper leveling rolls and the lower leveling rolls which are not retracted becomes non-uniform and the steel plate may be unable to be adequately flattened. Therefore, in the roller leveler, after retracted, the seven pieces of the lower leveling rolls are moved in the carrying direction of the steel plate by a half of the pitch of the upper leveling rolls by the moving mechanism. In this manner, the pitch in the carrying direction between the upper leveling rolls and the lower leveling rolls which are not retracted is set to be uniform.

A retract mechanism for retracting the leveling rolls from the pass line has been known which is provided with a wedge on a fixed side (fixed side wedge), which is fixed on an upper face or an under face of a holding member rotatably holding plural pieces of backup rolls that are arranged in an axial direction of the leveling roll, and a wedge on a movable side (movable side wedge) with which a cylinder is connected (see, for example, U.S. Pat. No. 5,412,968). In this retract mechanism, the fixed side wedge and the movable side wedge are formed in a rectangular triangle shape when viewed in the carrying direction of the steel plate and their slant faces are abutted with each other. Further, when the movable side wedge is moved in the axial direction of the leveling roll, some of the upper leveling rolls and the lower leveling rolls are moved to the pass line side and retracted from the pass line.

SUMMARY OF THE INVENTION

In the roller leveler described in Hei 5-57350 and Sho 62-203616, when the pitch of the leveling rolls used for flattening a steel plate is to be changed, the lower leveling rolls are required to be moved by the moving mechanism in order to set the pitch in the carrying direction between the upper leveling rolls and the lower leveling rolls which are not retracted to be uniform. In other words, in this roller leveler, when the pitch of the leveling rolls used for flattening of a steel plate is to be changed, the moving mechanism is required for setting the pitch in the carrying direction between the upper leveling rolls and the lower leveling rolls which are not retracted to be uniform. Therefore, in this roller leveler, the structure of the apparatus is complicated.

In order to achieve the above-mentioned object, there is provided a roller leveler in which a steel plate is flattened while being carried, including a first roll group which is provided with "n" pieces of first leveling rolls ("n" is an integer of 4 or more) which are arranged with a predetermined first pitch in a carrying direction of the steel plate, a second roll group which is provided with "n+1" pieces of second leveling rolls which are arranged with the first pitch in the carrying direction of the steel plate and are disposed in a zigzag manner with respect to the first leveling rolls, which is disposed so as to face the first roll group through a pass line where the steel plate is passed, a first retract mechanism which makes some pieces of the first leveling rolls retract from the pass line for changing a number of the first leveling rolls which are used for flattening the steel plate, and a second retract mechanism which makes some pieces of the second leveling rolls retract from the pass line for changing a number of the second leveling rolls which are used for flattening the steel plate. The second roll group is provided with at least a third leveling roll which is disposed on at least one of an upstream side and a downstream side in the carrying direction of the steel plate and which is disposed with the first pitch or with a pitch of "m" times of the first pitch ("m" is an integer of 2 or more) with respect to the second leveling roll in the carrying direction of the steel plate.

In the present invention, for example, the third leveling roll is disposed on both sides of the upstream side and the downstream side in the carrying direction of the steel plate. Further, in this case, for example, one piece of the third leveling roll is disposed on both of the upstream side and the downstream side in the carrying direction of the steel plate.

In the roller leveler in the present invention, the second roll group is provided with at least a third leveling roll which is disposed on at least one of an upstream side and a downstream side in the carrying direction of the steel plate (hereinafter, "carrying direction") and which is disposed with the first pitch or with a pitch of "m" times of the first pitch with respect to the second leveling roll in the carrying direction. Therefore, in the present invention, even when the number of the leveling rolls is relatively small, a pitch in the carrying direction of the first leveling rolls and the second leveling roll and the third leveling roll which are not retracted and arranged in a zigzag manner can be made substantially uniform by utilizing the third leveling roll and only by means of that a predetermined number of the first leveling rolls and a predetermined number of the second leveling rolls are retracted.

For example, in a case that the first roll group is provided with four pieces of the first leveling rolls, the second roll group is provided with five pieces of the second leveling rolls, and one piece of the third leveling roll is disposed on each of the upstream side and the downstream side in the carrying direction with the first pitch with respect to the second leveling roll, it may be structured so that two pieces of the first leveling rolls which are the second and the third from the upstream side in the carrying direction are retracted and four pieces of the second leveling rolls except the third from the upstream side in the carrying direction are retracted. In this case, a pitch in the carrying direction between the third leveling roll which is disposed on the upstream side and the first leveling roll which is the first from the upstream side, a pitch in the carrying direction between the first leveling roll which is the first from the upstream side and the second leveling roll which is the third from the upstream side, a pitch in the carrying direction between the second leveling roll which is the third from the upstream side and the first leveling roll which is the fourth from the upstream side, and a pitch in the carrying direction between the first leveling roll which is the fourth from the upstream side and the third leveling roll which is disposed on the downstream side can be made substantially equal to each other.

As described above, in the present invention, even in a case that a moving mechanism for moving the first roll group or the second roll group in the carrying direction is not provided, when a pitch of the leveling rolls used for flattening a steel plate is changed, a pitch in the carrying direction of the leveling rolls which are arranged in a zigzag manner can be made substantially uniform by utilizing the third leveling roll and only by means of that a predetermined number of the first leveling rolls and a predetermined number of the second leveling rolls are retracted. Therefore, in the present invention, the mechanism for moving the first roll group or the second roll group in the carrying direction is not required. As a result, in the present invention, even in a case that the number of the leveling rolls is relatively small, when a pitch of the leveling rolls used for flattening a steel plate is changed, the pitch in the carrying direction of the leveling rolls arranged in a zigzag manner can be made substantially uniform with a relatively simple structure.

In the present invention, it is preferable that the first roll group is provided with "4+3k" pieces of the first leveling rolls ("k" is an integer of 0 or more), the second roll group is provided with "5+3k" pieces of the second leveling rolls, the third leveling roll is disposed with the first pitch with respect to the second leveling roll in the carrying direction of the steel plate, the first retract mechanism makes two adjacent first leveling rolls retract from the pass line for changing a pitch of the first leveling rolls which are used for flattening the steel plate, and the second retract mechanism makes two adjacent second leveling rolls retract from the pass line for changing a pitch of the second leveling rolls which are used for flattening the steel plate. According to this structure, the third leveling rolls which are respectively disposed on the upstream side and the downstream side in the carrying direction have a function of flattening the steel plate. Therefore, when a steel plate is flattened by the first leveling rolls and the second leveling rolls which are arranged with a pitch of three times of the first pitch, the third leveling roll can be utilized effectively.

In the present invention, it is preferable that the roller leveler is provided with a first holding roll and a second holding roll for holding the steel plate on the pass line on at least one of the upstream side and the downstream side with respect to the first roll group in the carrying direction of the steel plate, and the first holding roll and the second holding roll are disposed in a shifted state each other in the carrying direction of the steel plate. According to this structure, the first holding roll and the second holding roll can be properly used according to a pitch of the leveling rolls which are used for flattening of the steel plate. Therefore, even when a pitch of the leveling rolls used for flattening the steel plate is changed, the steel plate can be adequately held on the pass line.

In the present invention, it is preferable that the roller leveler is provided with a first holding member which rotatably holds the first holding roll, a second holding member which rotatably holds the second holding roll, a first moving mechanism by which the first holding roll is moved toward the pass line and retracted from the pass line, and a second moving mechanism by which the second holding roll is moved toward the pass line and retracted from the pass line. In addition, the second holding member is turnably connected to the first holding member, and the second moving mechanism is attached to the first holding member to turn the second holding member. According to this structure, another member for attaching the second holding member and the second moving mechanism is not required separately. Therefore, the structure of the roller leveler is capable of being simplified.

As described above, in the roller leveler in the present invention, even when the number of the leveling rolls is relatively small, when the pitch of the leveling rolls used for flattening the steel plate is changed, a pitch in the carrying direction of the leveling rolls which are arranged in a zigzag manner can be made substantially uniform with a relatively simple structure.

DETAILED DESCRIPTION OF THE PREFERRED EMBODIMENTS

Embodiments of the present invention will be described below with reference to the accompanying drawings.

First Embodiment

Schematic Structure of Roller Leveler

Figure 1:
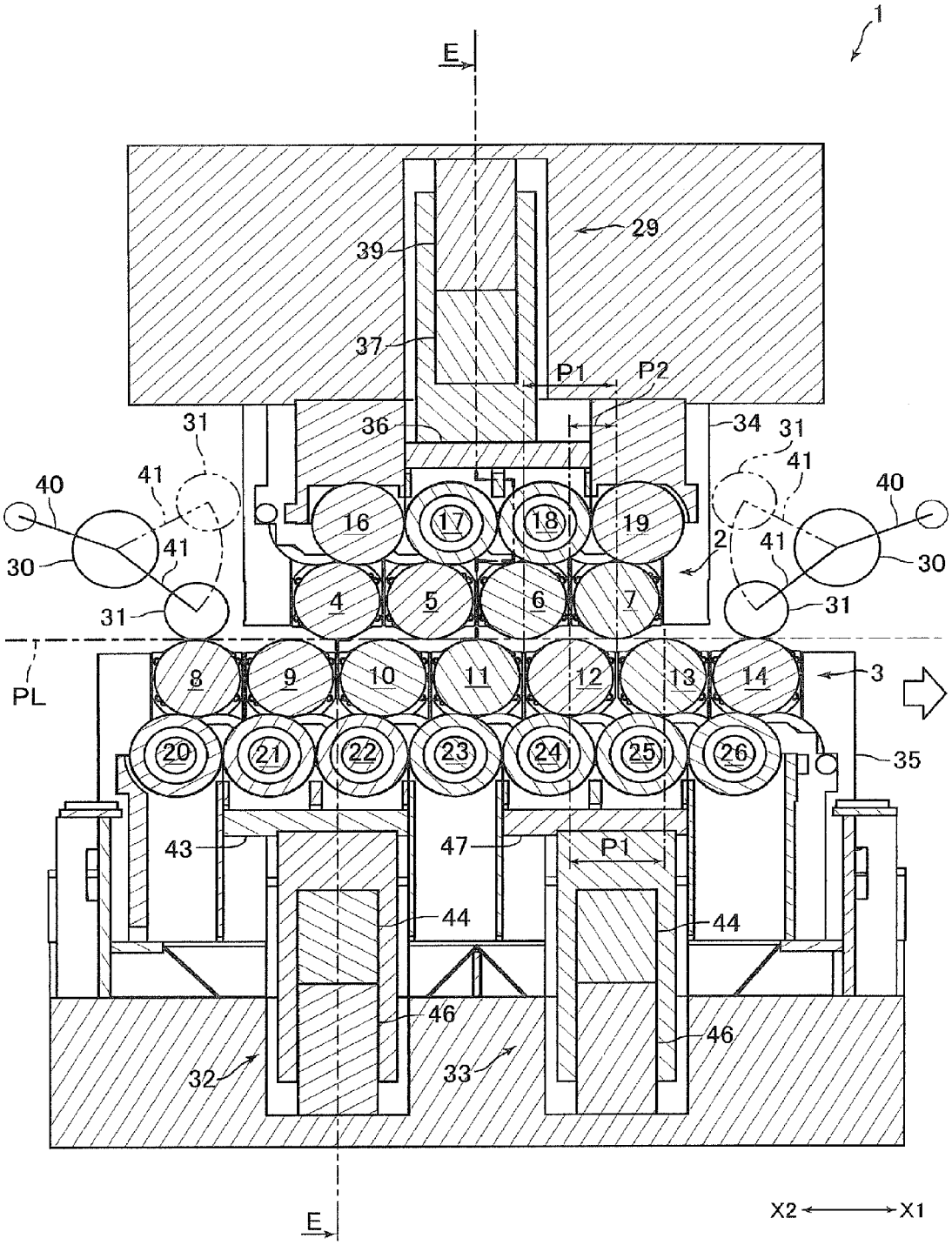
FIG. 1 is an explanatory cross-sectional side view showing a structure of an essential part of a roller leveler in accordance with a first embodiment of the present invention.
Figure 2:
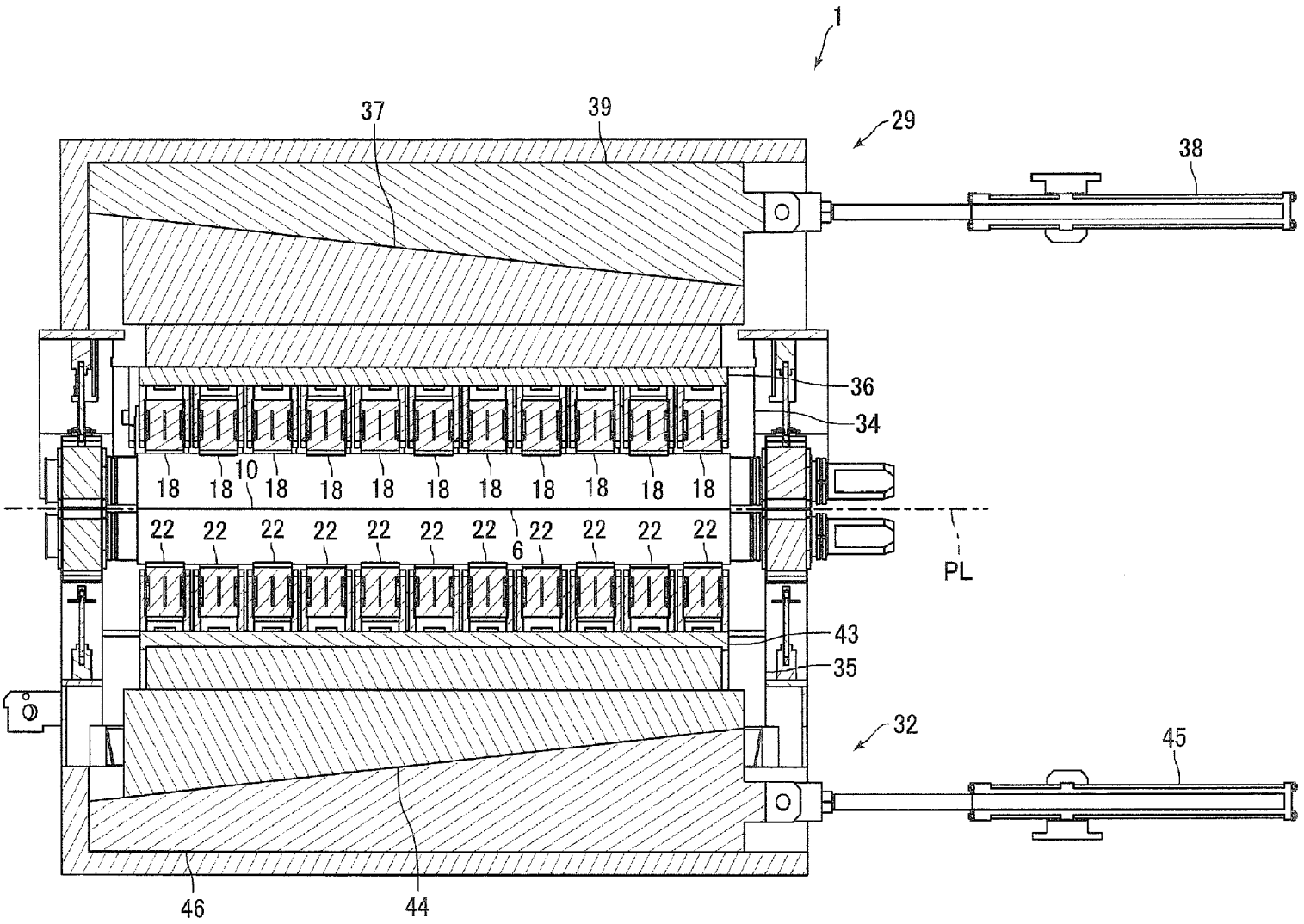
FIG. 2 is a cross-sectional view showing the structure which is cut by "E-E" in FIG. 1.
Figure 3:
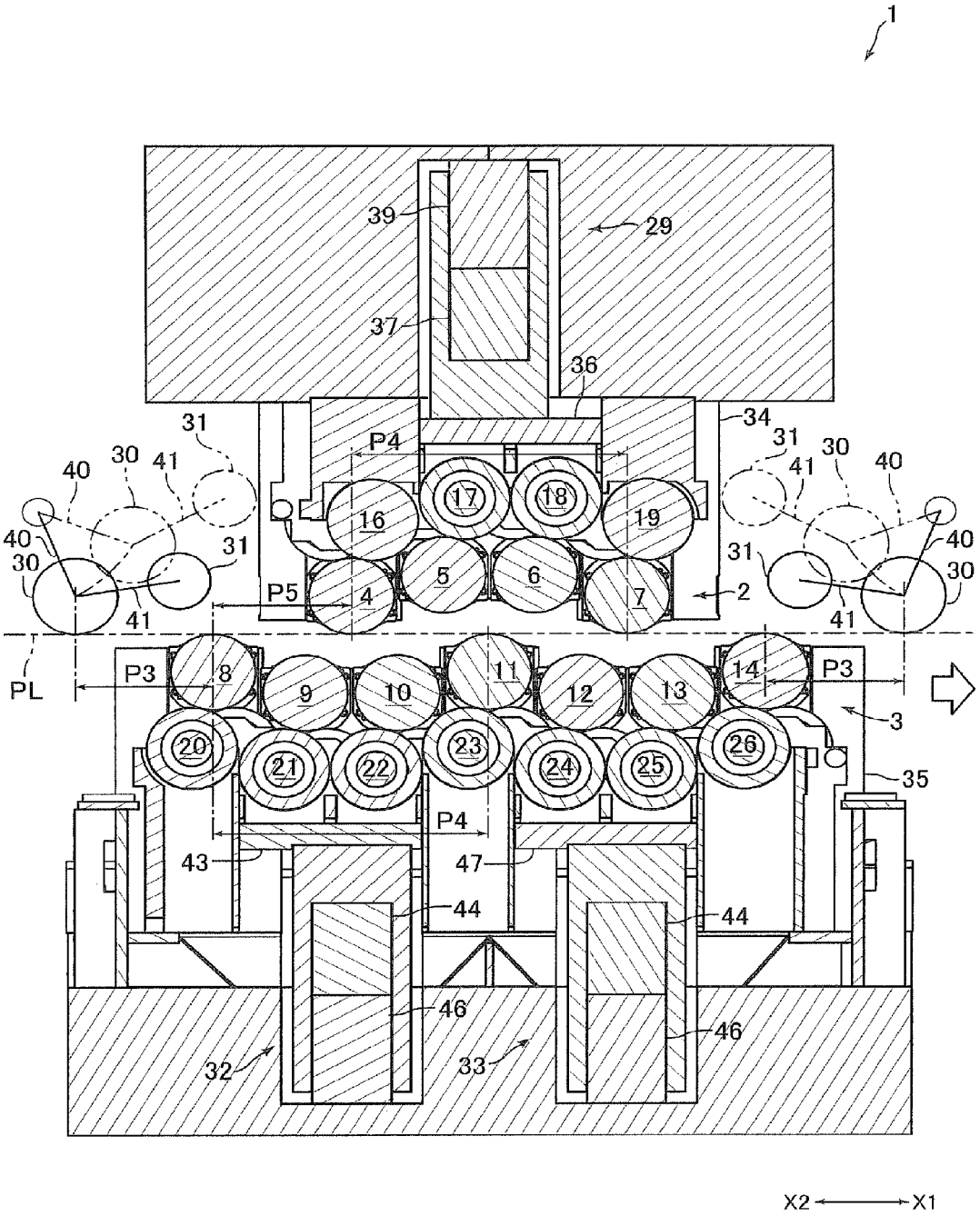
FIG. 3 is a cross-sectional view showing a state where some of upper leveling rolls and lower leveling rolls have been retracted from a state shown in FIG. 1.
Figure 4:
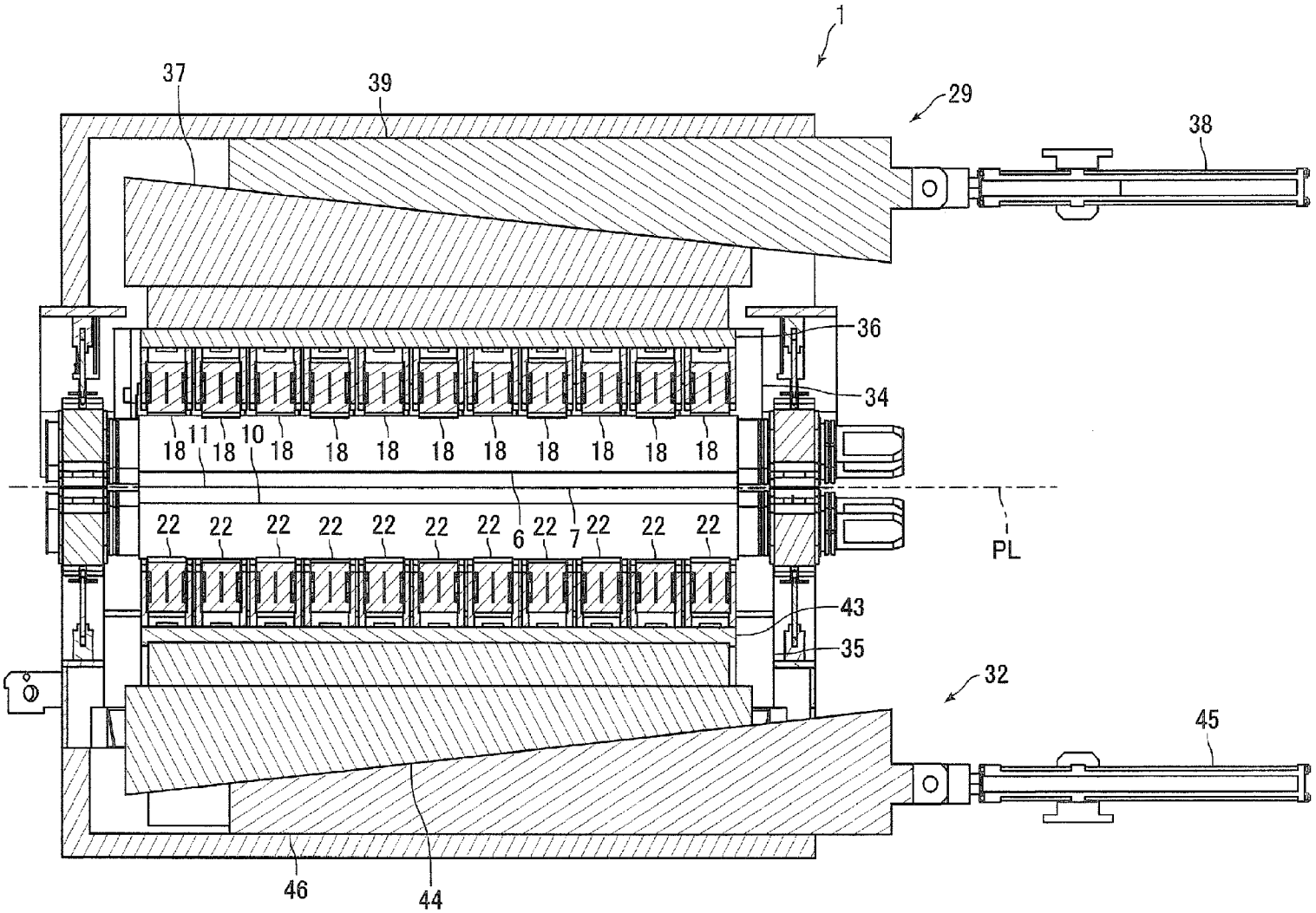
FIG. 4 is a cross-sectional view showing a state where some of the upper leveling rolls and the lower leveling rolls have been retracted from a state shown in FIG. 2.

FIG. 1 is an explanatory cross-sectional side view showing a structure of an essential part of a roller leveler 1 in accordance with a first embodiment of the present invention. FIG. 2 is a cross-sectional view showing the structure which is cut by "E-E" in FIG. 1. FIG. 3 is a cross-sectional view showing a state where upper leveling rolls 5 and 6 and lower leveling rolls 9, 10, 12 and 13 have been retracted from the state shown in FIG. 1. FIG. 4 is a cross-sectional view showing a state where the upper leveling roll 6 and the lower leveling roll 10 have been retracted from a state shown in FIG. 2.

A roller leveler 1 in the first embodiment is a device in which a steel plate (not shown) formed in a plate shape or a belt shape that is rolled by a rolling mill is flattened while being carried. The roller leveler 1 is structured so that both of a thick steel plate and a thin steel plate whose thicknesses are different from each other are capable of being flattened by changing a pitch of leveling rolls which are used for flattening the steel plate. In this embodiment, a steel plate is carried in an "X1" direction in FIG. 1. In other words, in this embodiment, the "X1" direction is the carrying direction of a steel plate. Further, in this embodiment, a side in the "X2" direction is an upstream side in the carrying direction of a steel plate, and a side in the "X1" direction is a downstream side in the carrying direction of the steel plate. In this embodiment, the "X1" direction is the "carrying direction". Further, the side in the "X2" direction is an "upstream side" and the side in the "X1" direction is a "downstream side".

As shown in FIG. 1, the roller leveler 1 is provided with an upper roll group 2, which is disposed on an upper side of a pass line "PL" where a steel plate is passed, and a lower roll group 3 which is disposed on a lower side of the pass line "PL". In other words, the roller leveler 1 is provided with the upper roll group 2 and the lower roll group 3 which are disposed to face each other through the pass line "PL". The upper roll group 2 is provided with four pieces of upper leveling rolls 4 through 7 which are arranged with a pitch "P1" in the carrying direction. The lower roll group 3 is provided with seven pieces of lower leveling rolls 8 through 14 which are arranged with the pitch "P1" in the carrying direction. In this embodiment, when the upper leveling rolls 4 through 7 and the lower leveling rolls 8 through 14 are collectively indicated, they are expressed as "leveling rolls".

The upper leveling rolls 4 through 7 are disposed from the upstream side to the downstream side in this order. The lower leveling rolls 8 through 14 are disposed from the upstream side to the downstream side in this order. Further, the upper leveling rolls 4 through 7 and the lower leveling rolls 9 through 13 are disposed so as to sandwich the pass line "PL" in a zigzag manner. In other words, a pitch "P2" between the upper leveling rolls 4 through 7 and the lower leveling rolls 9 through 13 in the carrying direction is set to be substantially a half of the pitch "P1".

In this embodiment, the upper leveling rolls 4 through 7 is first leveling rolls and the lower leveling rolls 9 through 13 are second leveling rolls. Further, the upper roll group 2 in this embodiment is a first roll group and the lower roll group 3 is a second roll group. In addition, the pitch "P1" in this embodiment is a predetermined first pitch. Further, the lower leveling rolls 8 and 14 in this embodiment are third leveling rolls which are disposed on the upstream side and the downstream side with the first pitch "P1" in the carrying direction with respect to the lower leveling rolls 9 and 13, i.e., the second leveling rolls.

Further, the roller leveler 1 is provided with backup rolls 16 through 19 for restraining deflections of the upper leveling rolls 4 through 7 and backup rolls 20 through 26 for restraining deflections of the lower leveling rolls 8 through 14. In addition, the roller leveler 1 is provided with first holding rolls 30 and second holding rolls 31 for holding a steel plate on the pass line "PL" on the upstream side and the downstream side of the upper roll group 2, a retract mechanism 29 as a first retract mechanism which makes the upper leveling rolls 5 and 6 retract from the pass line "PL", and retract mechanisms 32 and 33 as a second retract mechanism which makes the lower leveling rolls 9, 10, 12 and 13 retract from the pass line "PL".

The backup rolls 16 through 19 are arranged from the upstream side to the downstream side in this order. The backup rolls 16 through 19 are respectively abutted with upper end faces of the upper leveling rolls 4 through 7 and have a function of restraining respective deflections of the upper leveling rolls 4 through 7. Further, as shown in FIG. 2, a plurality of backup rolls 18 is arranged with a predetermined pitch in an axial direction of the upper leveling roll 6. Specifically, a plurality of backup rolls 18 is arranged in the axial direction of the upper leveling roll 6 in a zigzag manner. Similarly, a plurality of backup rolls 16, 17 and 19 are arranged in a zigzag manner with a predetermined pitch in the axial direction of the upper leveling rolls 4, 5 and 7.

The backup rolls 20 through 26 are arranged from the upstream side to the downstream side in this order. The backup rolls 20 through 26 are respectively abutted with lower end faces of the lower leveling rolls 8 through 14 and have a function of restraining respective deflections of the lower leveling rolls 8 through 14. Further, as shown in FIG. 2, a plurality of backup rolls 22 is arranged with a predetermined pitch in an axial direction of the lower leveling roll 10. Specifically, a plurality of the backup rolls 22 is arranged in the axial direction of the lower leveling roll 10 in a zigzag manner. Similarly, a plurality of backup rolls 20, 21, 23 through 26 are arranged in a zigzag manner with a predetermined pitch in the axial direction of the lower leveling rolls 8, 9, 11 through 14.

The first holding roll 30 and the second holding roll 31 are disposed in a shifted state each other in the carrying direction. Specifically, on the upstream side of the upper roll group 2, the first holding roll 30 is disposed on the upstream side with respect to the second holding roll 31 and, on the downstream side of the upper roll group 2, the first holding roll 30 is disposed on the downstream side with respect to the second holding roll 31.

The first holding roll 30 is rotatably held at one end side of a first holding member 40 which is formed in a lever shape. The first holding member 40 is turnably connected to a main body frame of the roller leveler 1. Further, the other end side of the first holding member 40 is attached to a tip end side of a rod of a cylinder (not shown), which is a first moving mechanism, and a main body of the cylinder is attached to the main body frame. In this embodiment, when the cylinder is operated, the first holding member 40 is turned and the first holding roll 30 is moved toward the pass line "PL" (see the solid line in FIG. 3) and, alternatively, the first holding roll 30 is retracted from the pass line "PL" (see the two-dot chain line in FIG. 3). The first holding roll 30 is retracted from the pass line "PL" when flattening of a steel plate is not performed, and so forth.

The second holding roll 31 is rotatably held at one end side of a second holding member 41 which is formed in a lever shape. The second holding member 41 is turnably connected to the first holding member 40. Further, the other end side of the second holding member 41 is attached to a tip end side of a rod of a cylinder (not shown), which is a second moving mechanism, and a main body of the cylinder is attached to the first holding member 40. In this embodiment, the cylinder is operated in a state where the first holding roll 30 is retracted from the pass line "PL". Further, when the cylinder is operated, the second holding member 41 is turned and the second holding roll 31 is moved toward the pass line "PL" (see the solid line in FIG. 1) and, alternatively, the second holding roll 31 is retracted from the pass line "PL" (see the two-dot chain line in FIG. 1). The second holding roll 31 is, as described below, retracted from the pass line "PL" when flattening of a relatively thin steel plate is not performed, and so forth.

As shown by the solid line in FIG. 3, in this embodiment, when the first holding roll 30 arranged on the upstream side of the upper roll group 2 is disposed on the pass line "PL" side, a pitch "P3" between the first holding roll 30 and the lower leveling roll 8 in the carrying direction is set to be about 1.5 times of the pitch "P1". Similarly, when the first holding roll 30 arranged on the downstream side of the upper roll group 2 is disposed on the pass line "PL" side, a pitch "P3" between the first holding roll 30 and the lower leveling roll 14 in the carrying direction is set to be about 1.5 times of the pitch "P1".

Further, as shown by the solid line in FIG. 1, when the second holding roll 31 arranged on the upstream side of the upper roll group 2 is disposed on the pass line "PL" side, the second holding roll 31 is disposed on the upper side of the lower leveling roll 8. Similarly, when the second holding roll 31 arranged on the downstream side of the upper roll group 2 is disposed on the pass line "PL" side, the second holding roll 31 is disposed on the upper side of the lower leveling roll 14.

As shown in FIGS. 1 and 2, the retract mechanism 29 is provided with one fixed side wedge 37, which is fixed to a holding frame 36 rotatably holding the backup rolls 17 and 18, and one movable side wedge 39 to which a cylinder 38 is connected. The fixed side wedge 37 and the movable side wedge 39 are disposed so that their inclined faces are abutted with each other. In this embodiment, the backup rolls 16 and 19 are rotatably held by a frame of an upper roll carriage 34 where the upper leveling rolls 4 through 7 are mounted.

In this embodiment, when a rod of the cylinder 38 is protruded, as shown in FIGS. 1 and 2, the backup rolls 17 and 18 are moved downward and the upper leveling rolls 5 and 6 are disposed on the pass line "PL" side. On the other hand, when the rod of the cylinder 38 is retracted, as shown in FIGS. 3 and 4, the backup rolls 17 and 18 are moved upward and the upper leveling rolls 5 and 6 are retracted from the pass line "PL". The retract mechanism 29 is provided with a moving mechanism such as a cylinder (not shown) for moving bearing parts of the upper leveling rolls 5 and 6 in an upper direction. When the upper leveling rolls 5 and 6 are to be retracted from the pass line "PL", the cylinder is operated to move the upper leveling rolls 5 and 6 upward.

As shown in FIGS. 1 and 2, the retract mechanism 32 is provided with one fixed side wedge 44, which is fixed to a holding frame 43 rotatably holding the backup rolls 21 and 22, and one movable side wedge 46 to which a cylinder 45 is connected. The fixed side wedge 44 and the movable side wedge 46 are disposed so that their inclined faces are abutted with each other. In this embodiment, when a rod of the cylinder 45 is protruded, as shown in FIGS. 1 and 2, the backup rolls 21 and 22 are moved upward and the lower leveling rolls 9 and 10 are disposed on the pass line "PL" side. On the other hand, when the rod of the cylinder 45 is retracted, as shown in FIGS. 3 and 4, the backup rolls 21 and 22 are moved downward and the lower leveling rolls 9 and 10 are retracted from the pass line "PL".

The retract mechanism 33 is substantially similarly structured to the retract mechanism 32. In other words, the retract mechanism 33 is provided with one fixed side wedge 44, which is fixed to a holding frame 47 rotatably holding the backup rolls 24 and 25, and one movable side wedge 46 to which a cylinder 45 is connected. Similarly to the retract mechanism 32, when a rod of the cylinder 45 is protruded, the backup rolls 24 and 25 are moved upward and the lower leveling rolls 12 and 13 are disposed on the pass line "PL" side. On the other hand, when the rod of the cylinder 45 is retracted, the backup rolls 24 and 25 are moved downward and the lower leveling rolls 12 and 13 are retracted from the pass line "PL". The backup rolls 20, 23 and 26 are rotatably held by a frame 35 on which the lower leveling rolls 8 through 14 are mounted.

Arrangement of Leveling Rolls at the Time of Steel Plate Flattening

In the roller leveler 1 structured as described above, a pitch of the leveling rolls used when flattening of a relatively thin steel plate is performed is different from a pitch of the leveling rolls used when flattening of a relatively thick steel plate is performed. In other words, leveling rolls which are used when flattening of a relatively thin steel plate is performed are different from leveling rolls which are used when flattening of a relatively thick steel plate is performed.

When flattening of a relatively thin steel plate is performed, as shown in FIG. 1, all of the upper leveling rolls 4 through 7 and the lower leveling rolls 8 through 14 are disposed on the pass line "PL" side. In this case, the upper leveling rolls 4 through 7 and the lower leveling rolls 9 through 13 are used to flatten a steel plate. In other words, in this case, a pitch of the upper leveling rolls 4 through 7 and a pitch of the lower leveling rolls 9 through 13 used for flattening are the pitch "P1". Further, when flattening of a relatively thin steel plate is to be performed, as shown by the solid line in FIG. 1, the first holding rolls 30 are retracted from the pass line "PL" and the second holding rolls 31 are disposed on the pass line "PL" side. In this case, the second holding rolls 31 have a function of holding the steel plate on the pass line "PL" on the upstream side and the downstream side of the upper roll group 2.

On the other hand, when flattening of a relatively thick steel plate is performed, as shown in FIG. 3, the upper leveling rolls 4 and 7 are disposed on the pass line "PL" side and the upper leveling rolls 5 and 6 are retracted from the pass line "PL". Further, the lower leveling rolls 8, 11 and 14 are disposed on the pass line "PL" side and the lower leveling rolls 9, 10, 12 and 13 are retracted from the pass line "PL". In other words, in this case, two adjacent upper leveling rolls 5 and 6, two adjacent lower leveling rolls 9 and 10 and two adjacent lower leveling rolls 12 and 13 are retracted from the pass line "PL".

Further, in this case, the upper leveling rolls 4 and 7 and the lower leveling rolls 8, 11 and 14 are used for flattening a steel plate. In other words, a pitch "P4" of the upper leveling rolls 4 and 7 and a pitch "P4" of the lower leveling rolls 8, 11 and 14 which are used for flattening a steel plate are three times of the pitch "P1". Further, in the carrying direction, a pitch "P5" between the lower leveling roll 8 and the upper leveling roll 4, a pitch "P5" between the upper leveling roll 4 and the lower leveling roll 11, a pitch "P5" between the lower leveling roll 11 and the upper leveling roll 7, and a pitch "P5" between the upper leveling roll 7 and the lower leveling roll 14 are 1.5 times of the pitch "P1".

Further, when flattening of a relatively thick steel plate is to be performed, as shown by the solid line in FIG. 3, the first holding rolls 30 are disposed on the pass line "PL" side and the second holding rolls 31 are retracted from the pass line "PL". In other words, in this case, the first holding rolls 30 have a function of holding a steel plate on the pass line "PL" on the upstream side and the downstream side of the upper roll group 2.

Principal Effects in First Embodiment

As described above, in the first embodiment, the lower leveling rolls 9 through 13 are disposed in a zigzag manner with respect to the upper leveling rolls 4 through 7 and, in addition, the lower leveling roll 8 is disposed on the upstream side of the lower leveling roll 9 and the lower leveling roll 14 is disposed on the downstream side of the lower leveling roll 13. Therefore, in this embodiment, even in a case that a total number of the leveling rolls is eleven (11), i.e., the total number is relatively small, a pitch in the carrying direction between the upper leveling rolls 4 and 7 and the lower leveling rolls 8, 11 and 14 arranged in a zigzag manner is set to be substantially constant by utilizing the lower leveling rolls 8 and 14 and only by means of that the upper leveling rolls 5 and 6 and the lower leveling rolls 9, 10, 12 and 13 are retracted. In other words, in this embodiment, even though a conventional moving mechanism for moving the lower roll group 3 in the carrying direction is not provided, a pitch in the carrying direction between the upper leveling rolls 4 and 7 and the lower leveling rolls 8, 11 and 14 which are arranged in a zigzag manner is set to be substantially constant by utilizing the lower leveling rolls 8 and 14. Therefore, in this embodiment, even in a case that the number of the leveling rolls is relatively small, when a pitch of the leveling rolls used for flattening a steel plate is changed, the pitch in the carrying direction between the upper leveling rolls 4 and 7 and the lower leveling rolls 8, 11 and 14 is set to be substantially constant with a relatively simple structure.

In this embodiment, the upper roll group 2 is provided with four pieces of the upper leveling rolls 4 through 7 and the lower roll group 3 is provided with seven pieces of the lower leveling rolls 8 through 14. Therefore, when flattening of a relatively thick steel plate is performed, the lower leveling roll 8 disposed on the most upstream side and the lower leveling roll 14 disposed on the most downstream side have a function of flattening the steel plate. Therefore, in this embodiment, when a steel plate is flattened by using the upper leveling rolls 4 and 7 and the lower leveling rolls 8, 11 and 14 which are arranged with the pitch "P4" that is three times of the pitch "P1", the lower leveling rolls 8 and 14 disposed on the most upstream side and the most downstream side are utilized.

On the other hand, for example, in a case that the upper roll group 2 is provided with five pieces of the upper leveling rolls and the lower roll group 3 is provided with eight pieces of the lower leveling rolls, when flattening of a steel plate is performed by using the upper leveling rolls and the lower leveling rolls which are arranged with the pitch "P4" that is three times of the pitch "P1", the lower leveling roll disposed on the most upstream side or the most downstream side does not have a function of flattening the steel plate. In other words, in this case, the lower leveling roll which is disposed on the most upstream side or the most downstream side cannot be effectively utilized. However, in this embodiment, when flattening of a steel plate is performed by using the upper leveling rolls 4 and 7 and the lower leveling rolls 8, 11 and 14 which are arranged with the pitch "P4" that is three times of the pitch "P1", the lower leveling rolls 8 and 14 which are disposed on the most upstream side and the most downstream side can be utilized. Therefore, the steel plate is flattened by using the upper leveling rolls 4 and 7 and the lower leveling rolls 8, 11 and 14 arranged with the pitch "P4" that is three times of the pitch "P1" while the structure of the roller leveler 1 is simplified.

In this embodiment, the first holding roll 30 and the second holding roll 31 are disposed in a shifted state with each other in the carrying direction. Therefore, when flattening of a relatively thick steel plate is performed, the steel plate can be held on the pass line "PL" by utilizing the first holding roll 30 and, when flattening of a relatively thin steel plate is performed, the steel plate can be held on the pass line "PL" by utilizing the second holding roll 31. In other words, the first holding roll 30 and the second holding roll 31 can be properly used according to a pitch of the leveling rolls which are used for flattening a steel plate. Therefore, in this embodiment, even when a pitch of the leveling rolls used for flattening a steel plate is changed, the steel plate is adequately held on the pass line "PL".

In this embodiment, the second holding member 41 is attached to the first holding member 40. Further, the main body of the cylinder whose tip end side of the rod is attached to the second holding member 41 is also attached to the first holding member 40. Therefore, in this embodiment, another member for attaching the second holding member 41 and the cylinder is not required separately. Accordingly, in this embodiment, the structure of the roller leveler 1 is capable of being simplified.

Modified Examples of Leveling Roll's Number

In the first embodiment, the upper roll group 2 is provided with four pieces of the upper leveling rolls 4 through 7 and the lower roll group 3 is provided with seven pieces of the lower leveling rolls 8 through 14. However, the number of the upper leveling rolls provided in the upper roll group 2 is not limited to four and the number of the lower leveling rolls provided in the lower roll group 3 is not limited to seven.

Figure 5A:
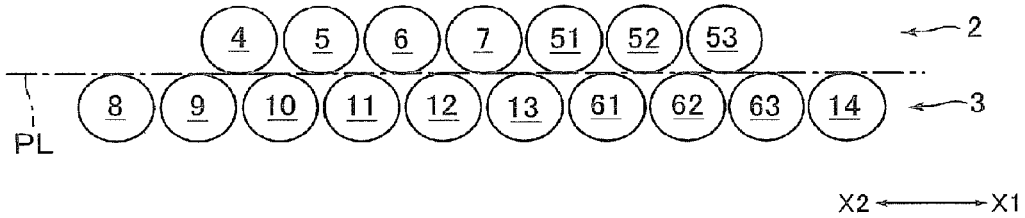
FIGS. 5(A) and 5(B) are views showing arrangements of leveling rolls in accordance with a modified example of the first embodiment.
Figure 5B:
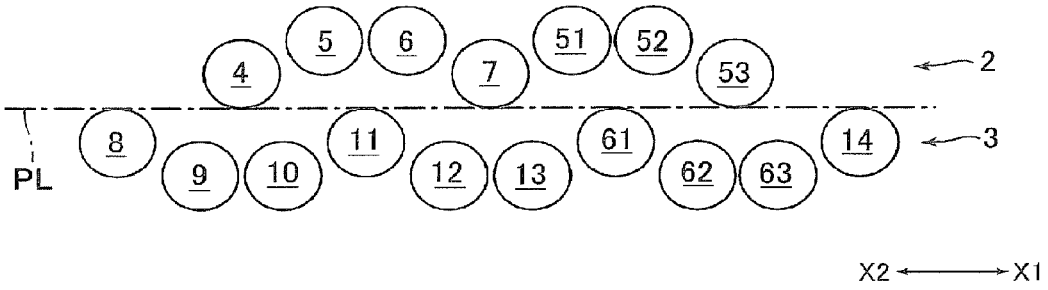

For example, as shown in FIGS. 5(A) and 5(B), the upper roll group 2 may be provided with seven pieces of upper leveling rolls 4 through 7 and 51 through 53, and the lower roll group 3 may be provided with ten pieces of lower leveling rolls 8 through 14 and 61 through 63. In this case, the upper leveling rolls 4 through 7 and 51 through 53 and the lower leveling rolls 9 through 3 and 61 through 63 are disposed in a zigzag manner so as to sandwich the pass line "PL".

Further, in this case, when flattening of a relatively thin steel plate is performed, as shown in FIG. 5(A), the upper leveling rolls 4 through 7 and 51 through 53 and the lower leveling rolls 9 through 13 and 61 through 63 are used for flattening the steel plate. Further, when flattening of a relatively thick steel plate is performed, as shown in FIG. 5(B), the upper leveling rolls 5, 6, 51 and 52 are retracted from the pass line "PL" and the lower leveling rolls 9, 10, 12, 13, 62 and 63 are retracted from the pass line "PL", and the upper leveling rolls 4, 7 and 53 and the lower leveling rolls 8, 11, 61 and 14 are used for flattening the steel plate.

Figure 6A:
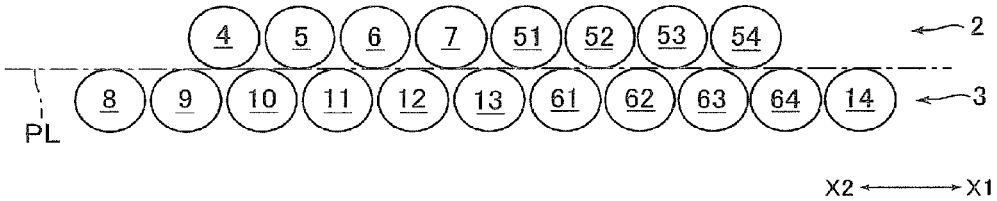
FIGS. 6(A), 6(B) and 6(C) are views showing arrangements of leveling rolls in accordance with a modified example of the first embodiment.
Figure 6B:
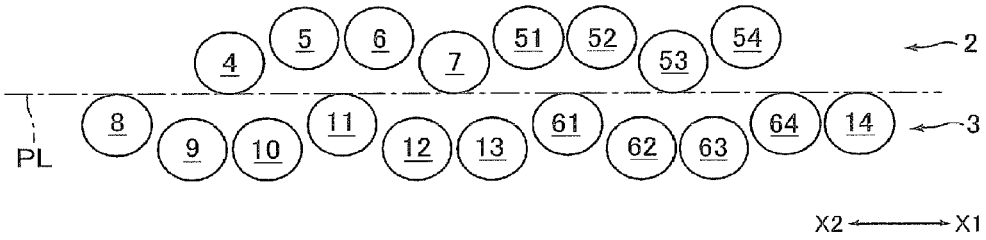
Figure 6C:
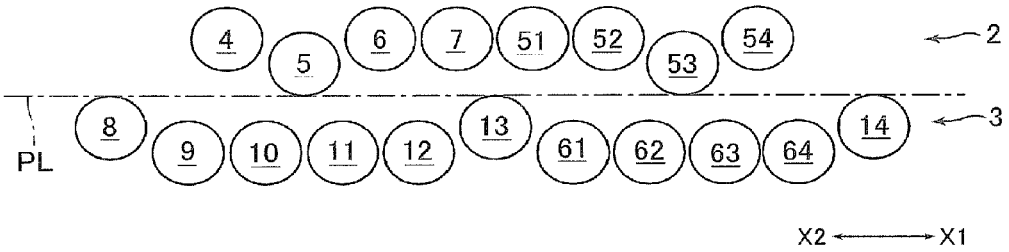

Further, for example, as shown in FIGS. 6(A), 6(B) and 6(C), the upper roll group 2 may be provided with eight pieces of upper leveling rolls 4 through 7 and 51 through 54 and the lower roll group 3 may be provided with eleven pieces of lower leveling rolls 8 through 14 and 61 through 64. In this case, the upper leveling rolls 4 through 7 and 51 through 54 and the lower leveling rolls 9 through 13 and 61 through 64 are disposed in a zigzag manner so as to sandwich the pass line "PL".

Further, in this case, when flattening of a relatively thin steel plate is performed, as shown in FIG. 6(A), the upper leveling rolls 4 through 7 and 51 through 54 and the lower leveling rolls 9 through 13 and 61 through 64 are used for flattening the steel plate. Further, when flattening of a relatively thick steel plate is performed, as shown in FIG. 6(B), the upper leveling rolls 5, 6, 51, 52 and 54 are retracted from the pass line "PL" and the lower leveling rolls 9, 10, 12, 13, 62 and 63 are retracted from the pass line "PL", and the upper leveling rolls 4, 7 and 53 and the lower leveling rolls 8, 11, 61 and 64 are used for flattening the steel plate. Further, when flattening of a further thicker steel plate is performed, as shown in FIG. 6(C), the upper leveling rolls 4, 6, 7, 51, 52 and 54 are retracted from the pass line "PL" and the lower leveling rolls 9 through 12 and 61 through 64 are retracted from the pass line "PL", and the upper leveling rolls 5 and 53 and the lower leveling rolls 8, 13 and 14 are used for flattening the steel plate.

Figure 7A:
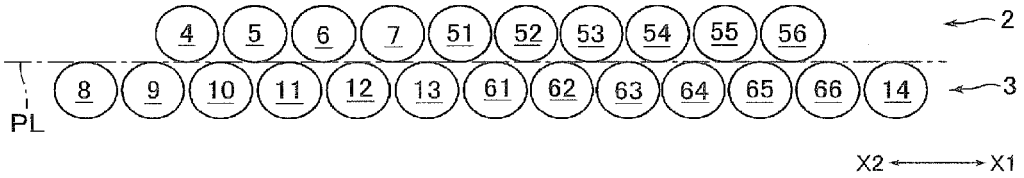
FIGS. 7(A), 7(B) and 7(C) are views showing arrangements of leveling rolls in accordance with a modified example of the first embodiment.
Figure 7B:
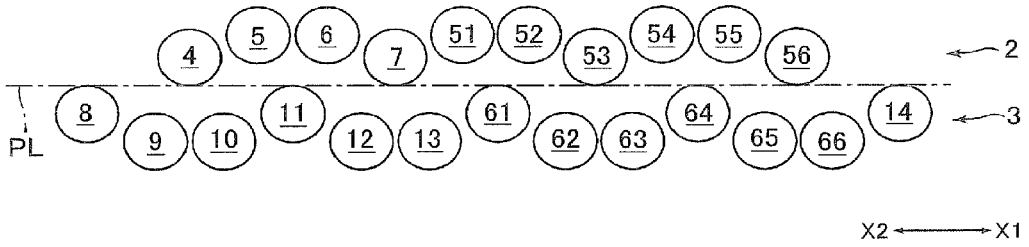
Figure 7C:
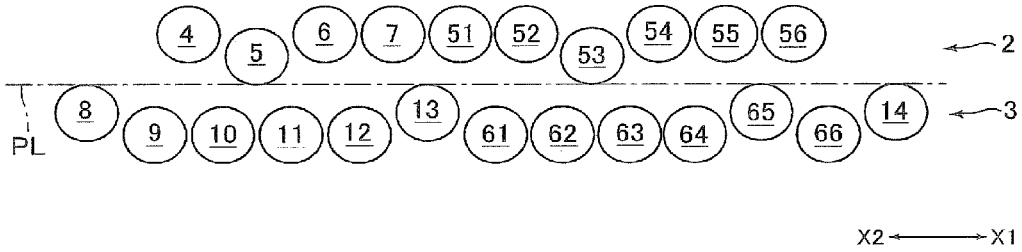

In addition, for example, as shown in FIGS. 7(A), 7(B) and 7(C), the upper roll group 2 may be provided with ten pieces of upper leveling rolls 4 through 7 and 51 through 56 and the lower roll group 3 may be provided with thirteen pieces of lower leveling rolls 8 through 14 and 61 through 66. In this case, the upper leveling rolls 4 through 7 and 51 through 56 and the lower leveling rolls 9 through 13 and 61 through 66 are disposed in a zigzag manner so as to sandwich the pass line "PL".

Further, in this case, when flattening of a relatively thin steel plate is performed, as shown in FIG. 7(A), the upper leveling rolls 4 through 7 and 51 through 56 and the lower leveling rolls 9 through 13 and 61 through 66 are used for flattening the steel plate. Further, when flattening of a relatively thick steel plate is performed, as shown in FIG. 7(B), the upper leveling rolls 5, 6, 51, 52, 54 and 55 are retracted from the pass line "PL" and the lower leveling rolls 9, 10, 12, 13, 62, 63, 65 and 66 are retracted from the pass line "PL", and the upper leveling rolls 4, 7, 53 and 56 and the lower leveling rolls 8, 11, 61, 64 and 14 are used for flattening the steel plate. Further, when flattening of a further thicker steel plate is performed, as shown in FIG. 7(C), the upper leveling rolls 4, 6, 7, 51 and 52 and 54 through 56 are retracted from the pass line "PL" and the lower leveling rolls 9 through 12 and 61 through 64 and 66 are retracted from the pass line "PL", and the upper leveling rolls 5 and 53 and the lower leveling rolls 8, 13 and 65 are used for flattening the steel plate.

In these embodiments, as shown in FIG. 1, FIGS. 5(A) and 5(B) and FIGS. 7(A), 7(B) and 7(C), in a case that the number of the upper leveling rolls of the upper roll group 2 is "4+3k" ("k" is an integer of 0 (zero) or more) and, in addition, in a case that the number of the lower leveling rolls of the lower roll group 3 which are disposed in a zigzag manner with respect to the upper leveling rolls is "5+3k", when two adjacent upper leveling rolls and two adjacent lower leveling rolls are retracted as shown in FIGS. 3, 5(B) and 7(B), the lower leveling roll 8 as the third leveling roll which is disposed on the most upstream side and the lower leveling roll 14 as the third leveling roll which is disposed on the most downstream side are used for flattening the steel plate. In these embodiments, when the leveling rolls are disposed as shown in FIG. 6(B) and/or, when the leveling rolls are disposed as shown in FIG. 7(C), the lower leveling roll 14 is not used for flattening a steel plate and thus the lower leveling roll 14 may be retracted from the pass line "PL".

Modified Examples of Arrangement of Third Leveling Roll

In the first embodiment, the lower leveling rolls 8 and 14 as the third leveling roll are respectively disposed on the upstream side and the downstream side of the lower leveling rolls 9 through 13 as the second leveling roll which are disposed in a zigzag manner with respect to the upper leveling rolls 4 through 7. However, the lower leveling roll as the third leveling roll may be disposed on only one side of the upstream side or the downstream side of the lower leveling rolls as the second leveling roll. For example, as shown in FIGS. 8(A) and 8(B), the lower leveling roll 8 as the third leveling roll may be disposed on only the upstream side of the lower leveling rolls 9 through 13 and 61 which are disposed in a zigzag manner with respect to the upper leveling rolls 4 through 7 and 51.

Figure 8A:
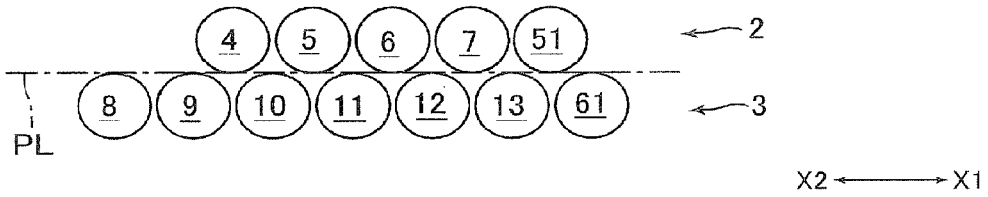
FIGS. 8(A) and 8(B) are views showing arrangements of leveling rolls in accordance with a modified example of the first embodiment.
Figure 8B:
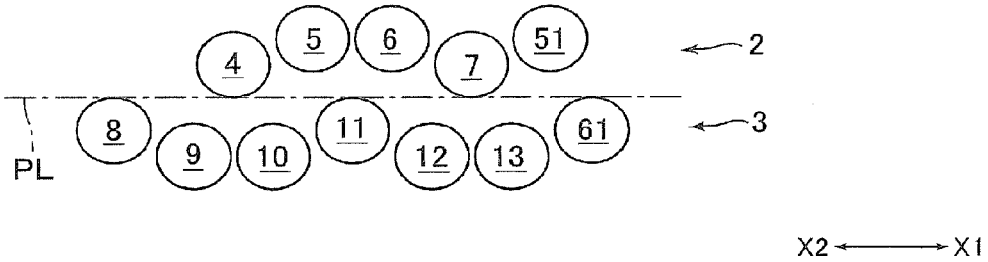

In this case, when flattening of a relatively thin steel plate is performed, as shown in FIG. 8(A), the upper leveling rolls 4 through 7 and 51 and the lower leveling rolls 9 through 13 and 61 are used for flattening the steel plate. Further, when flattening of a relatively thick steel plate is performed, as shown in FIG. 8(B), the upper leveling rolls 5, 6 and 51 are retracted from the pass line "PL" and the lower leveling rolls 9, 10, 12 and 13 are retracted from the pass line "PL", and the upper leveling rolls 4 and 7 and the lower leveling rolls 8, 11 and 61 are used for flattening the steel plate.

In the first embodiment, the lower leveling rolls 8 and 14 as the third leveling roll are disposed on the upstream side and the downstream side of the lower leveling rolls 9 through 13 as the second leveling roll which are disposed in a zigzag manner with respect to the upper leveling rolls 4 through 7. However, two or more pieces of the lower leveling rolls as the third leveling roll may be disposed on each of the upstream side and the downstream side of the lower leveling rolls as the second leveling roll. For example, as shown in FIGS. 9(A), 9(B) and 9(C), two pieces of lower leveling rolls 68 and 8 as the third leveling roll may be disposed on the upstream side of the lower leveling rolls 9 through 13, 61 and 62 which are disposed in a zigzag manner with respect to the upper leveling rolls 4 through 7, 51 and 52, and two pieces of lower leveling rolls 14 and 69 as the third leveling roll may be disposed on the downstream side of the lower leveling rolls 9 through 13, 61 and 62.

Figure 9A:
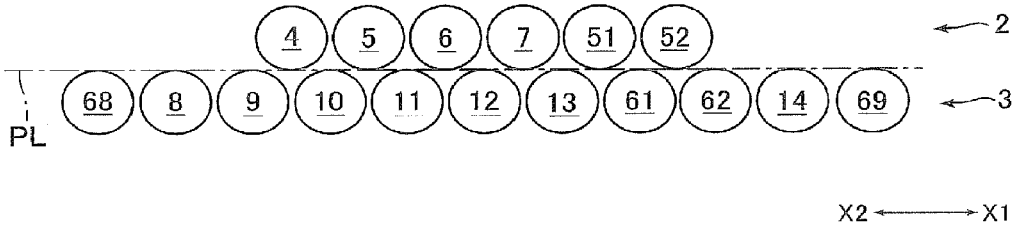
FIGS. 9(A), 9(B) and 9(C) are views showing arrangements of leveling rolls in accordance with a modified example of the first embodiment.

In this case, when flattening of a relatively thin steel plate is performed, as shown in FIG. 9(A), the upper leveling rolls 4 through 7, 51 and 52 and the lower leveling rolls 9 through 13, 61 and 62 are used for flattening the steel plate. Further, when flattening of a relatively thick steel plate is performed, as shown in FIG. 9(B), the upper leveling rolls 5, 6, 51 and 52 are retracted from the pass line "PL" and the lower leveling rolls 9, 10, 12, 13 and 62 are retracted from the pass line "PL", and the upper leveling rolls 4 and 7 and the lower leveling rolls 8, 11 and 61 are used for flattening the steel plate. Further, when flattening of a further thicker steel plate is performed, as shown in FIG. 9(C), the upper leveling rolls 5 through 7 and 51 are retracted from the pass line "PL" and the lower leveling rolls 8 through 11, 13, 61, 62 and 14 are retracted from the pass line "PL", and the upper leveling rolls 4 and 52 and the lower leveling rolls 68, 12 and 69 are used for flattening the steel plate.

Figure 9B:
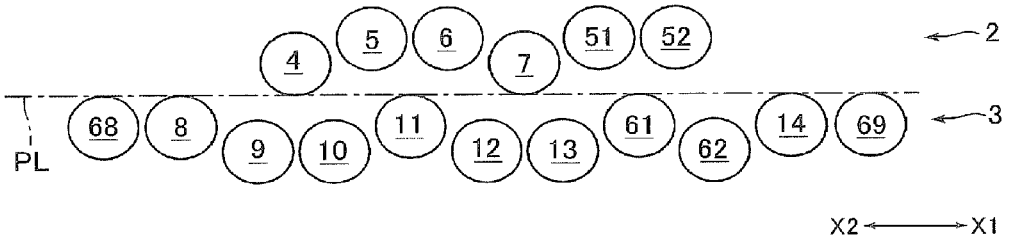
Figure 9C:
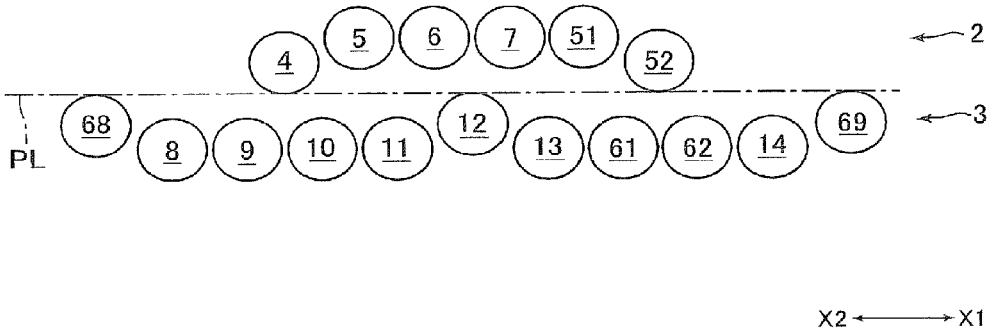

In the arrangement of the leveling rolls shown in FIGS. 9(A), 9(B) and 9(C), no lower leveling rolls 8 and 14 may be provided. In other words, the lower leveling roll 68 as the third leveling roll may be disposed with a pitch of two times of the pitch "P1" with respect to the lower leveling roll 9 as the second leveling roll disposed on the most upstream side, and the lower leveling roll 69 as the third leveling roll may be disposed with a pitch of two times of the pitch "P1" with respect to the lower leveling roll 62 as the second leveling roll disposed on the most downstream side. Also in this case, similar effects to the above-mentioned embodiments are obtained. In other words, also in this case, as shown in FIG. 9(C), when the upper leveling rolls 5 through 7 and 51 and the lower leveling rolls 9 through 11, 13, 61 and 62 are simply retracted, a pitch in the carrying direction between the upper leveling rolls 4 and 52 and the lower leveling rolls 68, 12 and 69 which are arranged in a zigzag manner is capable of being substantially constant by utilizing the lower leveling rolls 68 and 69.

Similarly, it may be structured that one of the third leveling rolls is disposed with a pitch of three times of the pitch "P1" with respect to the second leveling roll which is disposed on the most upstream side and the other of the third leveling rolls is disposed with a pitch of three times of the pitch "P1" with respect to the second leveling roll which is disposed on the most downstream side. In other words, it may be structured that one of the third leveling rolls is disposed with a pitch of "m"-times ("m" is an integer of 2 or more) of the pitch "P1" with respect to the second leveling roll which is disposed on the most upstream side and the other of the third leveling rolls is disposed with a pitch of "m"-times of the pitch "P1" with respect to the second leveling roll which is disposed on the most downstream side.

Other Modified Examples

In the first embodiment, the upper roll group 2 is provided with four pieces of the upper leveling rolls 4 through 7 and the lower roll group 3 is provided with seven pieces of the lower leveling rolls 8 through 14. However, it may be structured that the upper roll group 2 is provided with seven pieces of the upper leveling rolls and the lower roll group 3 is provided with four pieces of the lower leveling rolls.

Figure 10:
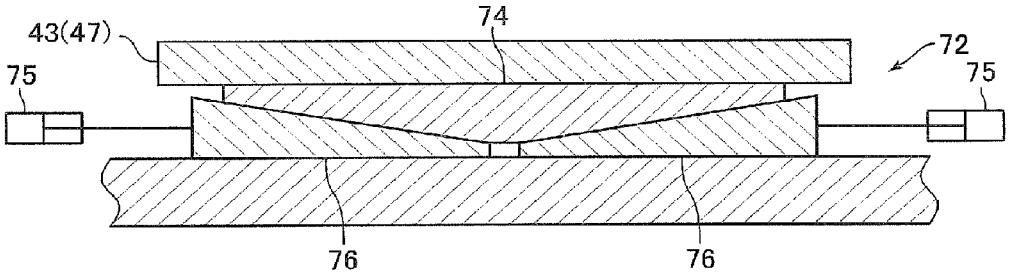
FIG. 10 is an explanatory schematic view showing a structure of a second retract mechanism in accordance with a modified example of the first embodiment.
Figure 11:
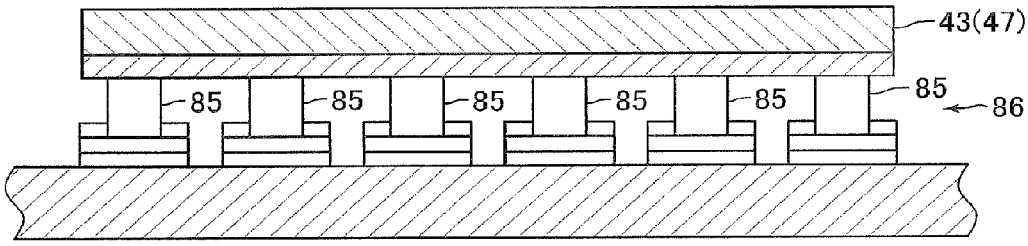
FIG. 11 is an explanatory schematic view showing a structure of a second retract mechanism in accordance with a modified example of the first embodiment.

In the first embodiment, the retract mechanisms 32 and 33 as the second retract mechanism for making the lower leveling rolls 9, 10, 12 and 13 retract from the pass line "PL" are structured of one fixed side wedge 44, one movable side wedge 46 and the like. However, the second retract mechanism may be structured like a retract mechanism 72 as shown in FIG. 10 which is structured of one fixed side wedge 74 which is provided with inclined faces which form a substantially "V"-shape when viewed in the carrying direction, two movable side wedges 76, and the like. In this case, two movable side wedges 76 are disposed so as to juxtapose in an axial direction of the leveling roll and a cylinder 75 is connected with each of the two movable side wedges 76. Further, the second retract mechanism may be structured like a retract mechanism 86 as shown in FIG. 11 which is structured of a plurality of cylinders 85 in an oil pressure type or the like.

Similarly, in the first embodiment, the retract mechanism 29 as the first retract mechanism for making the upper leveling rolls 5 and 6 retract from the pass line "PL" is structured of one fixed side wedge 37, one movable side wedge 39 and the like. However, the first retract mechanism may be, similarly to the retract mechanism 72 shown in FIG. 10, structured of one fixed side wedge 74, two movable side wedges 76 and the like. Further, the first retract mechanism may be, similarly to the retract mechanism 86 shown in FIG. 11, structured of a plurality of cylinders 85. In addition, a type of the first retract mechanism and a type of the second retract mechanism may be different from each other.

In the first embodiment and the modified example shown in FIG. 10, the cylinders 38, 45 and 75 are connected with the movable side wedges 39, 46 and 76. However, another drive source such as a motor may be connected with the movable side wedges 39, 46 and 76.

In the first embodiment, the roller leveler 1 is provided with the first holding roll 30 and the second holding roll 31 for holding a steel plate on the pass line "PL". However, the roller leveler 1 may be provided with only the first holding roll 30. In other words, the roller leveler 1 may be provided with no second holding roll 31.

Second Embodiment

Schematic Structure of Roller Leveler

Figure 12:
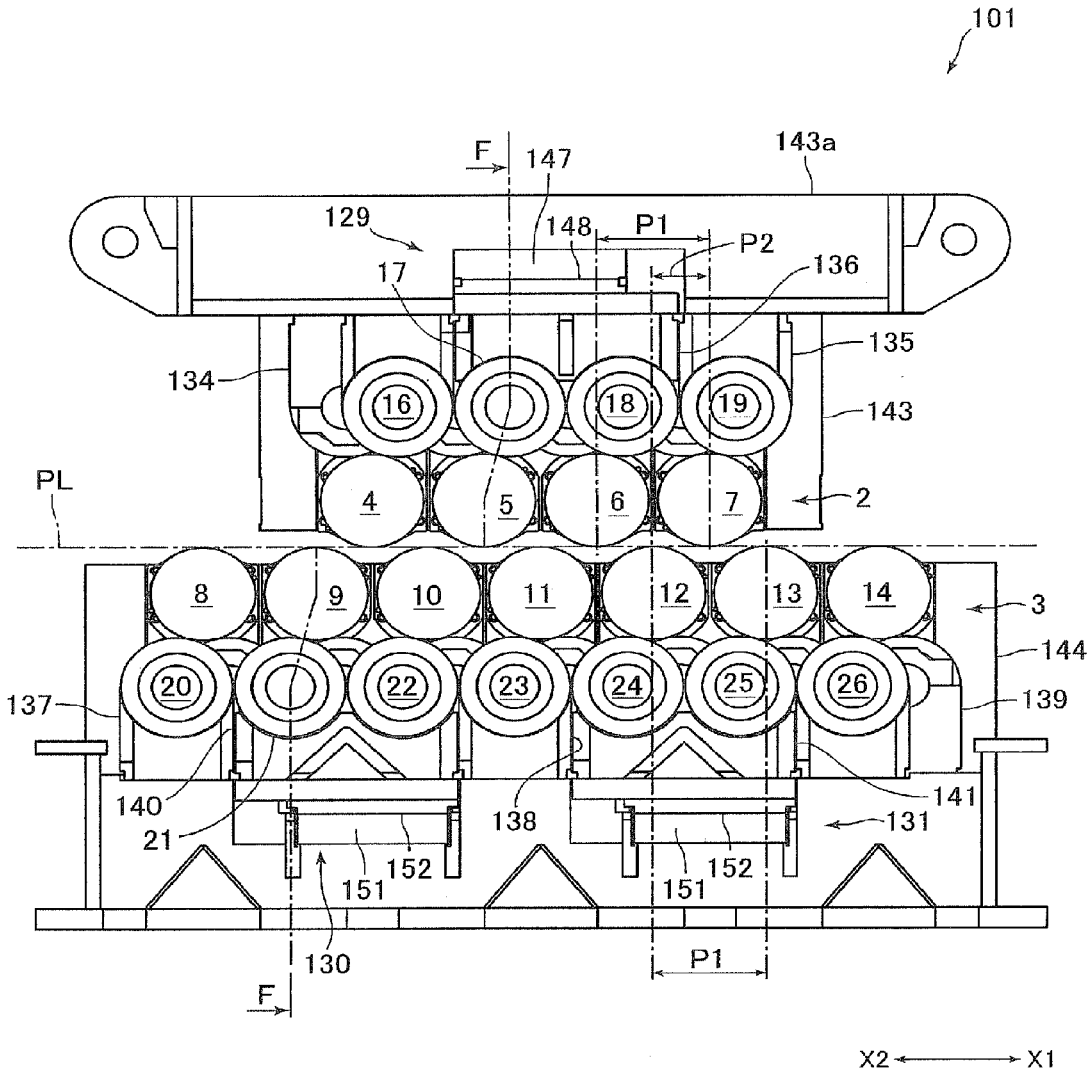
FIG. 12 is an explanatory cross-sectional side view showing a structure of an essential part of a roller leveler in accordance with a second embodiment of the present invention.
Figure 13:
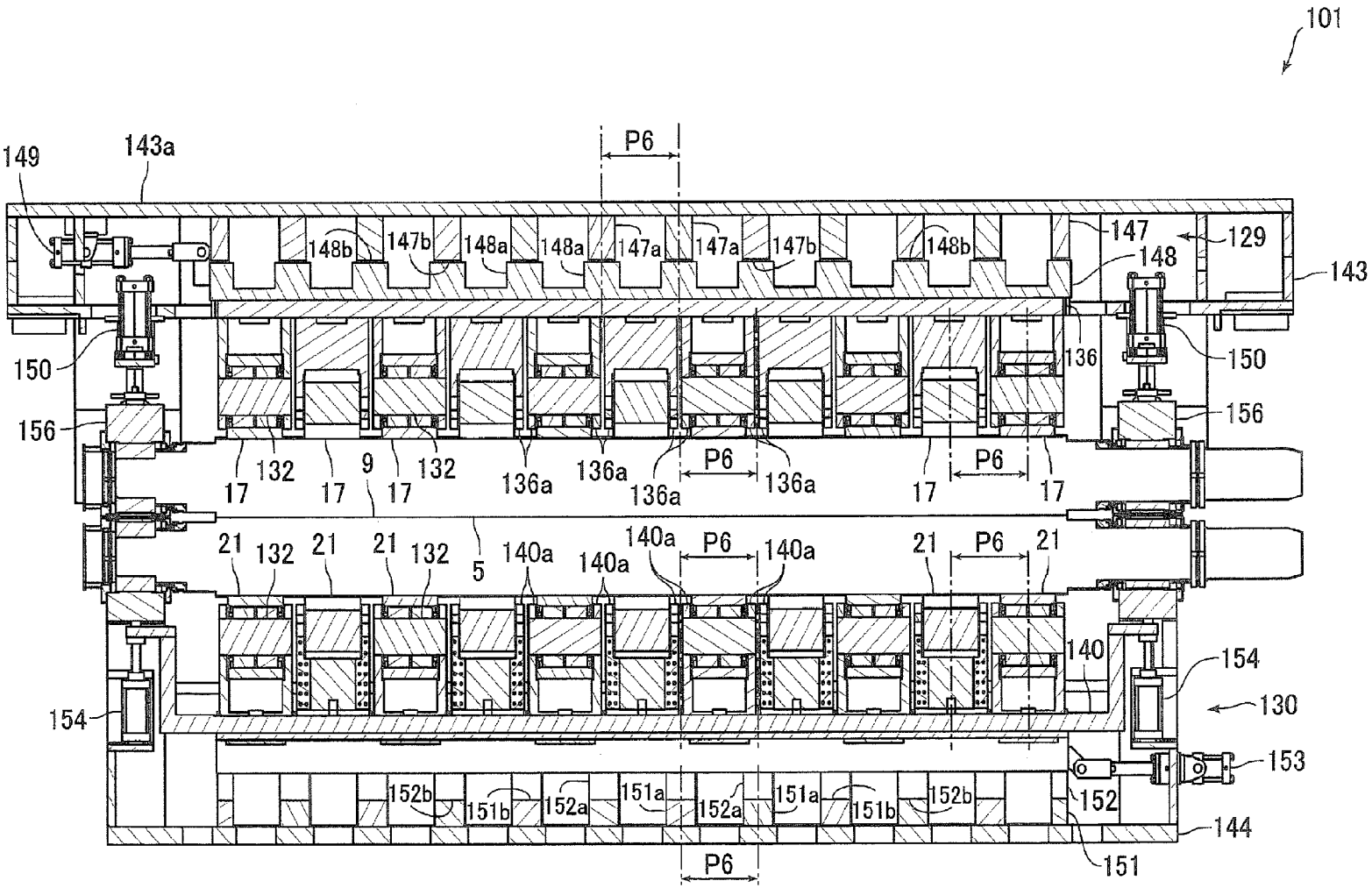
FIG. 13 is a cross-sectional view showing the structure which is cut by "F-F" in FIG. 12.
Figure 14:
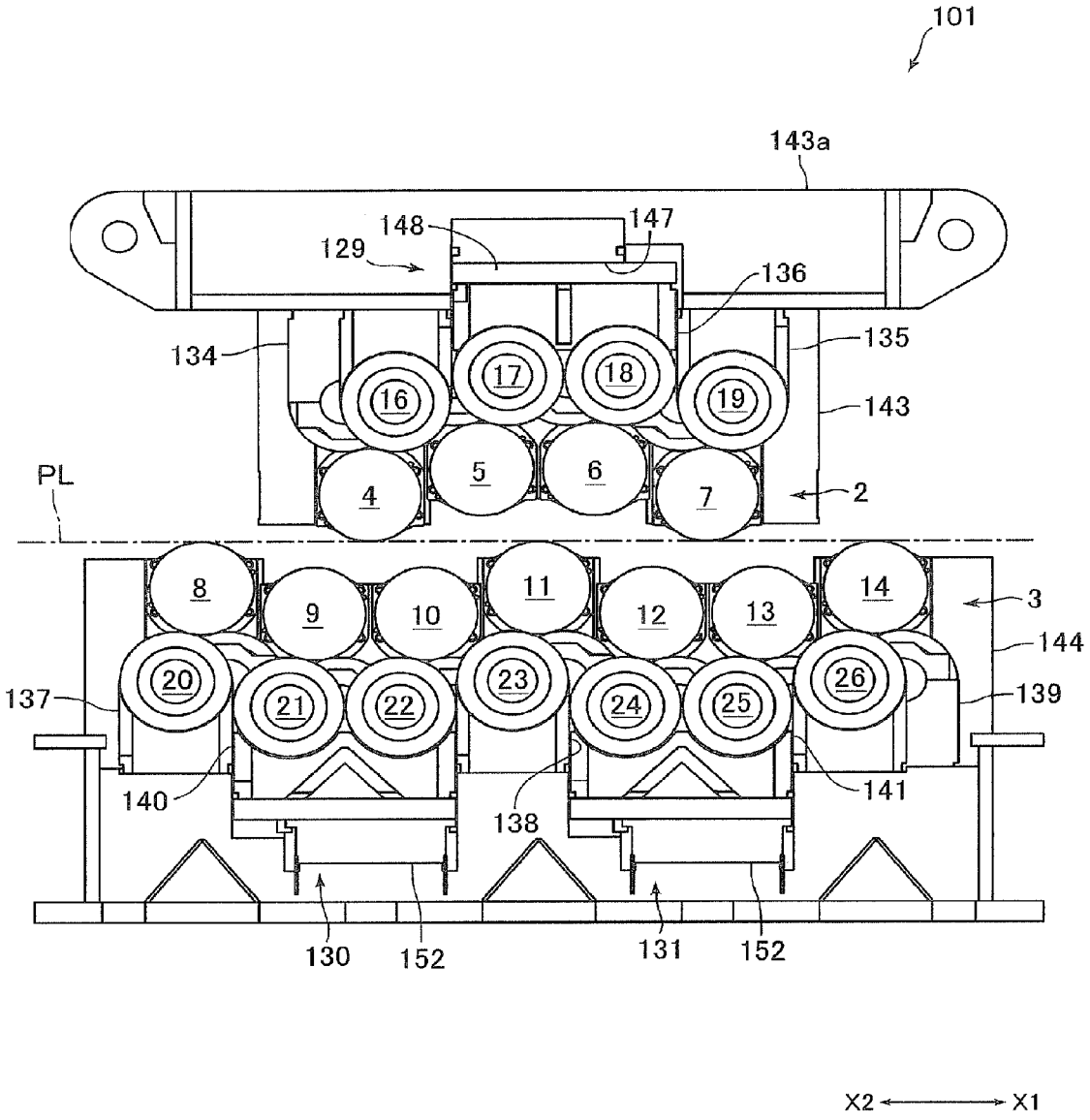
FIG. 14 is a cross-sectional view showing a state where some of upper leveling rolls and lower leveling rolls have been retracted from a state shown in FIG. 12.
Figure 15:
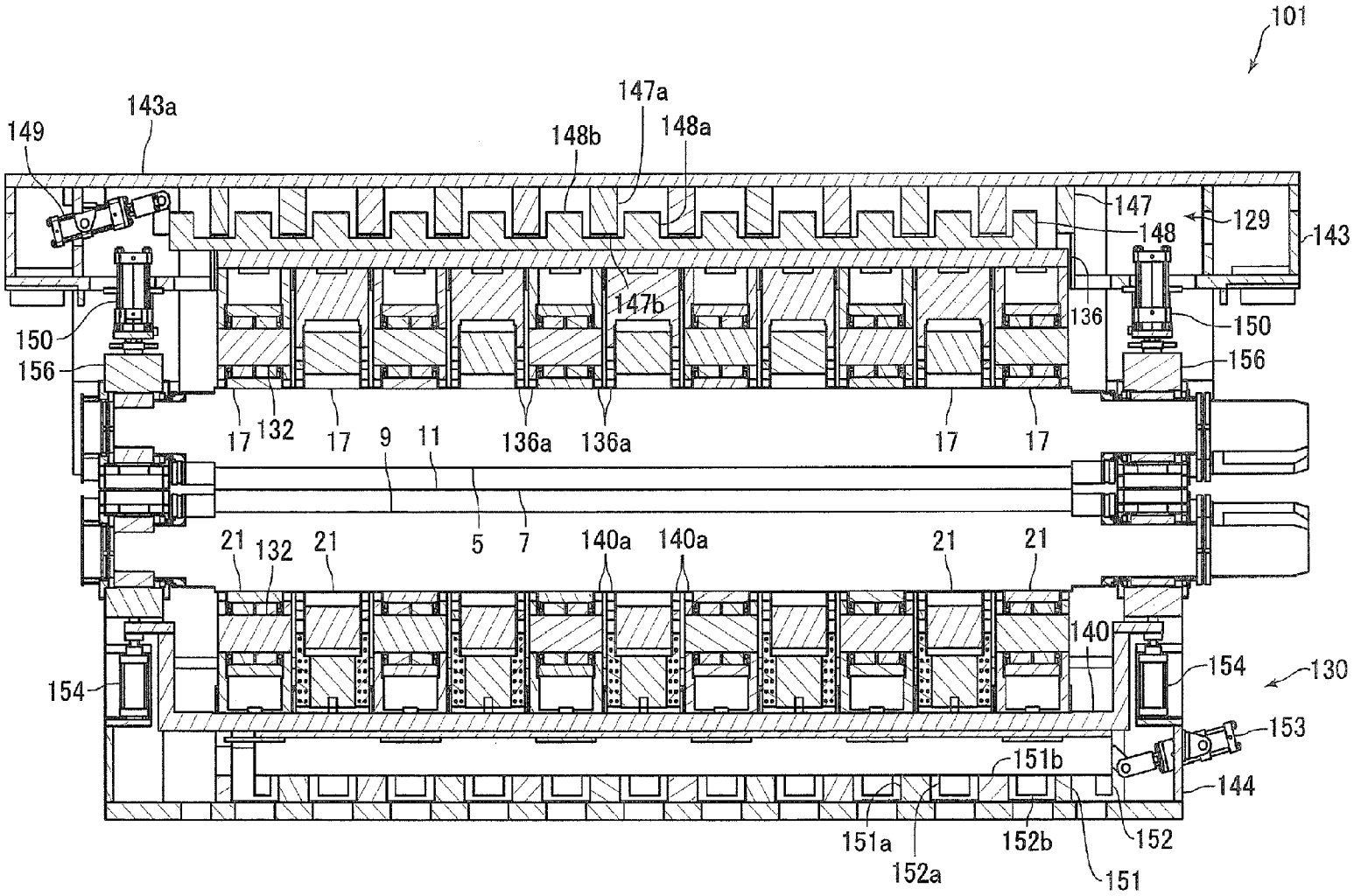
FIG. 15 is a cross-sectional view showing a state where some of the upper leveling rolls and the lower leveling rolls have been retracted from a state shown in FIG. 13.

FIG. 12 is an explanatory cross-sectional side view showing a structure of an essential part of a roller leveler 101 in accordance with a second embodiment of the present invention. FIG. 13 is a cross-sectional view showing the structure which is cut by "F-F" in FIG. 12. FIG. 14 is a cross-sectional view showing a state where upper leveling rolls 5 and 6 and lower leveling rolls 9, 10, 12 and 13 have been retracted from the state shown in FIG. 12. FIG. 15 is a cross-sectional view showing a state where the upper leveling roll 5 and the lower leveling roll 9 have been retracted from the state shown in FIG. 13.

The roller leveler 101 in the second embodiment and the roller leveler 1 in the first embodiment are different from each other in the structure of the retract mechanism for making the leveling rolls retract from the pass line. Therefore, the structure of the roller leveler 101 in the second embodiment will be described below mainly on the difference. In the following description, the same reference signs are used for the structures of the roller leveler 101 which are common to the structures of the roller leveler 1 and their descriptions are omitted or simplified.

The roller leveler 101 is, similarly to the roller leveler 1, provided with the upper roll group 2 and the lower roll group 3. The upper roll group 2 is provided with four pieces of upper leveling rolls 4 through 7 and the lower roll group 3 is provided with seven pieces of lower leveling rolls 8 through 14. Further, the roller leveler 101 is, similarly to the roller leveler 1, provided with the backup rolls 16 through 26. In addition, the roller leveler 101 is provided with a first retract mechanism 129 for retracting the upper leveling rolls 5 and 6 from the pass line "PL", a second retract mechanism 130 for retracting the lower leveling rolls 9 and 10 from the pass line "PL" and a second retract mechanism 131 for retracting the lower leveling rolls 12 and 13 from the pass line "PL".

The backup rolls 16 through 19 are arranged from the upstream side to the downstream side in this order. Further, as shown in FIG. 13, a plurality of backup rolls 17 is arranged with a predetermined pitch "P6" in an axial direction of the leveling roll. Specifically, a plurality of backup rolls 17 is arranged in the axial direction of the leveling roll in a zigzag manner. Similarly, a plurality of backup rolls 16, 18 and 19 are arranged in a zigzag manner with the pitch "P6" in the axial direction of the leveling rolls. Further, the respective backup rolls 16 through 19 are arranged at substantially the same positions as each other in the axial direction of the leveling rolls. In other words, the respective backup rolls 16 through 19 are arranged so as to overlap with each other when viewed in the carrying direction.

The backup rolls 20 through 26 are arranged from the upstream side to the downstream side in this order. Further, as shown in FIG. 13, a plurality of backup rolls 21 is arranged with the pitch "P6" in the axial direction of the leveling roll. Specifically, a plurality of backup rolls 21 is arranged in the axial direction of the leveling roll in a zigzag manner. Similarly, a plurality of backup rolls 20, 22 through 26 are arranged in a zigzag manner with the pitch "P6" in the axial direction of the leveling rolls. Further, the respective backup rolls 20 through 26 are arranged at substantially the same positions as each other in the axial direction of the leveling rolls. In other words, the respective backup rolls 20 through 26 are arranged so as to overlap with each other when viewed in the carrying direction.

Further, the respective backup rolls 16 through 19 and the respective backup rolls 20 through 26 are arranged at substantially same positions as each other in the axial direction of the leveling roll. In other words, when viewed in the carrying direction, the respective backup rolls 16 through 19 and the respective backup rolls 20 through 26 are arranged so as to overlap with each other in the upper and lower direction.

Each of the backup rolls 16 through 26 is rotatably held by a fixed shaft 132 (see FIG. 13). The fixed shaft 132 which holds the backup roll 16 is supported by a shaft support frame 134 and the fixed shaft 132 which holds the backup roll 19 is supported by a shaft support frame 135. The fixed shaft 132 holding the backup roll 17 and the fixed shaft 132 holding the backup roll 18 are supported by a shaft support frame 136. The fixed shaft 132 holding the backup roll 20 is supported by a shaft support frame 137, and the fixed shaft 132 holding the backup roll 23 is supported by a shaft support frame 138, and the fixed shaft 132 holding the backup roll 26 is supported by a shaft support frame 139. The fixed shaft 132 holding the backup roll 21 and the fixed shaft 132 holding the backup roll 22 are supported by a shaft support frame 140, and the fixed shaft 132 holding the backup roll 24 and the fixed shaft 132 holding the backup roll 25 are supported by a shaft support frame 141.

The shaft support frames 134 and 135 are fixed to an upper roll carriage 143 on which the upper leveling rolls 4 through 7 are mounted, and the shaft support frame 136 is held by the upper roll carriage 143 so as to be capable of being moved up and down. The shaft support frames 137 through 139 are fixed to a lower roll frame 144 on which the lower leveling rolls 8 through 14 are mounted, and the shaft support frames 140 and 141 are held by the lower roll frame 144 so as to be capable of being moved up and down.

The shaft support frame 136 is, as shown in FIG. 13, formed with a plurality of shaft support parts 136*a* for supporting both end sides of the fixed shaft 132. Specifically, the shaft support frame 136 is formed with a plurality of the shaft support parts 136*a* with the pitch "P6" in the axial direction of the leveling roll. Similarly, the shaft support frame 140 is, as shown in FIG. 13, formed with a plurality of shaft support parts 140*a*, which support both end sides of the fixed shaft 132, with the pitch "P6" in the axial direction of the leveling roll. Further, each of the shaft support frames 134, 135, 137 through 139 and 141 is formed with a plurality of shaft support parts, which support both end sides of the fixed shaft 132, with the pitch "P6" in the axial direction of the leveling roll.

The shaft support parts which are formed in the shaft support frames 134 and 135 and the shaft support parts 136*a* are respectively arranged at substantially the same positions as each other in the axial direction of the leveling roll. In other words, the shaft support parts formed in the shaft support frames 134 and 135 and the shaft support parts 136*a* are respectively arranged so as to overlap with each other when viewed in the carrying direction. The shaft support parts which are formed in the shaft support frames 137 through 139 and 141 and the shaft support parts 140*a* are respectively arranged at substantially the same positions as each other in the axial direction of the leveling roll. In other words, the shaft support parts formed in the shaft support frames 137 through 139 and 141 and the shaft support parts 140*a* are respectively arranged so as to overlap with each other when viewed in the carrying direction.

Further, the shaft support parts formed in the shaft support frames 134 and 135 and the shaft support parts 136*a*, and the shaft support parts formed in the shaft support frames 137 through 139 and 141 and the shaft support parts 140*a*, are respectively arranged at substantially the same positions as each other in the axial direction of the leveling roll. In other words, when viewed in the carrying direction, the shaft support parts formed in the shaft support frames 134 and 135 and the shaft support parts 136*a*, and the shaft support parts formed in the shaft support frames 137 through 139 and 141 and the shaft support parts 140*a*, are respectively arranged so as to overlap with each other in the upper and lower direction.

The first retract mechanism 129 is provided with a fixed side recessed-and-protruded member 147 which is formed in a comb-like shape, a movable side recessed-and-protruded member 148 which is formed in a comb-like shape, and cylinders 149 and 150. The second retract mechanism 130 and the second retract mechanism 131 are structured similarly. The second retract mechanisms 130 and 131 are, similarly to the first retract mechanism 129, also provided with a fixed side recessed-and-protruded member 151 formed in a comb-like shape, a movable side recessed-and-protruded member 152 formed in a comb-like shape, and cylinders 153 and 154. Detailed structures of the first retract mechanism 129 and the second retract mechanisms 130 and 131 will be described below.

In the roller leveler 101 structured as described above, similarly to the first embodiment, when flattening of a relatively thin steel plate is performed, as shown in FIG. 12, all of the upper leveling rolls 4 through 7 and the lower leveling rolls 8 through 14 are disposed on the pass line "PL" side. In this case, the upper leveling rolls 4 through 7 and the lower leveling rolls 9 through 13 are used for flattening the steel plate. On the other hand, when flattening of a relatively thick steel plate is performed, as shown in FIG. 14, the upper leveling rolls 4 and 7 are disposed on the pass line "PL" side and the upper leveling rolls 5 and 6 are retracted from the pass line "PL". Further, the lower leveling rolls 8, 11 and 14 are disposed on the pass line "PL" side and the lower leveling rolls 9, 10, 12 and 13 are retracted from the pass line "PL". In this case, the upper leveling rolls 4 and 7 and the lower leveling rolls 8, 11 and 14 are used for flattening the steel plate.

In this embodiment, when flattening of a relatively thick steel plate is to be performed, the first retract mechanism 129 makes the upper leveling rolls 5 and 6 retract from the pass line "PL", the second retract mechanism 130 makes the lower leveling rolls 9 and 10 retract from the pass line "PL", and the second retract mechanism 131 makes the lower leveling rolls 12 and 13 retract from the pass line "PL".

Structures of First Retract Mechanism and Second Retract Mechanism

As described above, the first retract mechanism 129 is provided with the fixed side recessed-and-protruded member 147, the movable side recessed-and-protruded member 148 and the cylinders 149 and 150.

The fixed side recessed-and-protruded member 147 is formed in an upper frame 143*a* of an upper roll carriage 143. The fixed side recessed-and-protruded member 147 is, as shown in FIG. 13, formed with a plurality of fixed side protruded parts 147*a* which are protruded to the lower direction. The plurality of the fixed side protruded parts 147*a* are arranged with the pitch "P6" in the axial direction of the leveling roll. Further, the fixed side protruded parts 147*a*, and the shaft support parts formed in the shaft support frames 134 and 135 and the shaft support parts 136*a* are respectively arranged at substantially the same positions as each other in the axial direction of the leveling roll. In other words, when viewed in the carrying direction, each of the fixed side protruded parts 147*a* is arranged so as to overlap with each of the shaft support parts formed in the shaft support frames 134 and 135 and the shaft support parts 136*a* in the upper and lower direction.

The fixed side protruded part 147*a* is formed in a rectangular solid shape whose shape viewed in the carrying direction is rectangular. Further, heights of the plurality of the fixed side protruded parts 147*a* are substantially the same as each other. Further, the fixed side protruded parts 147*a* are formed in the same shape as each other except the fixed side protruded parts 147*a* which are disposed at both ends in the axial direction of the leveling roll. A width of the fixed side protruded part 147*a* which is disposed at both ends in the axial direction of the leveling roll is set to be narrower than a width of other fixed side protruded parts 147*a* in the axial direction of the leveling roll. A tip end (lower end) of the fixed side protruded part 147*a* is formed in a flat-like face which is substantially perpendicular to the upper and lower direction. The tip end of the fixed side protruded part 147*a* is a fixed side abutting face 147*b*.

The movable side recessed-and-protruded member 148 is disposed so as to abut with an upper face of the shaft support frame 136. The cylinder 149 as a moving mechanism is connected with one end of the movable side recessed-and-protruded member 148 in the axial direction of the leveling roll, and the movable side recessed-and-protruded member 148 is movable in the axial direction of the leveling roll. As shown in FIG. 13, the movable side recessed-and-protruded member 148 is formed with a plurality of movable side protruded parts 148*a* which are protruded to an upper direction. The plurality of the movable side protruded parts 148*a* is arranged with the pitch "P6" in the axial direction of the leveling roll.

The movable side protruded part 148*a* is formed in a rectangular solid shape whose shape viewed in the carrying direction is rectangular. Further, heights of the plurality of the movable side protruded parts 148*a* are substantially the same as each other. Further, the movable side protruded parts 148*a* are formed in the same shape as each other except the movable side protruded parts 148*a* which are disposed at both ends in the axial direction of the leveling roll. A width of the movable side protruded part 148*a* which is disposed at both ends in the axial direction of the leveling roll is set to be narrower than a width of other movable side protruded parts 148*a* in the axial direction of the leveling roll. A tip end (upper end) of the movable side protruded part 148*a* is formed in a flat-like face which is substantially perpendicular to the upper and lower direction. The tip end of the movable side protruded part 148*a* is a movable side abutting face 148*b*.

The cylinders 150 are disposed at both end sides in the axial direction of the upper leveling rolls 5 and 6. A rod of the cylinder 150 is, as shown in FIG. 13, connected with the bearing part 156 which supports each of the both end sides of the upper leveling rolls 5 and 6. Further, a main body of the cylinder 150 is fixed to the upper roll carriage 143 so that the rod is protruded toward the lower direction.

In this embodiment, when the upper leveling rolls 5 and 6 are located on the pass line "PL" side, as shown in FIG. 13, the fixed side abutting faces 147*b* and the movable side abutting faces 148*b* are abutted with each other. Further, when the upper leveling rolls 5 and 6 are to be retracted from the pass line "PL", as shown in FIG. 15, the movable side recessed-and-protruded member 148 is moved in the axial direction of the leveling roll by power of the cylinder 149. As a result, the movable side protruded parts 148*a* are moved between the fixed side protruded parts 147*a* and the fixed side protruded parts 147*a* are moved between the movable side protruded parts 148*a*. Further, the upper leveling rolls 5 and 6 are moved upward by the cylinders 150 and thus the upper leveling rolls 5 and 6 are retracted from the pass line "PL". In other words, when the upper leveling rolls 5 and 6 have been retracted from the pass line "PL", the movable side protruded parts 148*a* are disposed between the fixed side protruded parts 147*a* and the fixed side protruded parts 147*a* are disposed between the movable side protruded parts 148*a*.

As described above, the second retract mechanisms 130 and 131 are provided with a fixed side recessed-and-protruded member 151, a movable side recessed-and-protruded member 152 and cylinders 153 and 154.

The fixed side recessed-and-protruded member 151 is formed on the bottom face side of the lower roll frame 144. The fixed side recessed-and-protruded member 151 is, as shown in FIG. 13, formed with a plurality of fixed side protruded parts 151*a* which are protruded in the upper direction. The plurality of the fixed side protruded parts 151*a* is arranged with the pitch "P6" in the axial direction of the leveling roll. Further, the fixed side protruded parts 151*a*, and the shaft support parts formed in the shaft support frames 137 through 139 and 141 and the shaft support parts 140*a* are respectively arranged at substantially the same positions as each other in the axial direction of the leveling roll. In other words, when viewed in the carrying direction, each of the fixed side protruded parts 151*a* is arranged so as to overlap with each of the shaft support parts formed in the shaft support frames 137 through 139 and 141 and the shaft support parts 140*a* in the upper and lower direction.

The fixed side protruded part 151*a* is formed in a rectangular solid shape whose shape viewed in the carrying direction is rectangular. Further, heights of the plurality of the fixed side protruded parts 151*a* are substantially the same as each other. Further, the fixed side protruded parts 151*a* are formed in the same shape as each other except the fixed side protruded parts 151*a* which are disposed at both ends in the axial direction of the leveling roll. A width of the fixed side protruded part 151*a* which is disposed at both ends in the axial direction of the leveling roll is set to be narrower than a width of other fixed side protruded parts 151*a* in the axial direction of the leveling roll. A tip end (upper end) of the fixed side protruded part 151*a* is formed in a flat-like face which is substantially perpendicular to the upper and lower direction. The tip end of the fixed side protruded part 151*a* is a fixed side abutting face 151*b*.

The movable side recessed-and-protruded members 152 are disposed so as to abut with under faces of the shaft support frames 140 and 141. The cylinder 153 as a moving mechanism is connected with one end of the movable side recessed-and-protruded member 152 in the axial direction of the leveling roll, and the movable side recessed-and-protruded member 152 is movable in the axial direction of the leveling roll. Further, the movable side recessed-and-protruded members 152 are movably held by the shaft support frames 140 and 141. As shown in FIG. 13, the movable side recessed-and-protruded member 152 is formed with a plurality of movable side protruded parts 152*a* which are protruded in the lower direction. The plurality of the movable side protruded parts 152*a* is arranged with the pitch "P6" in the axial direction of the leveling roll.

The movable side protruded part 152*a* is formed in a rectangular solid shape whose shape viewed in the carrying direction is rectangular. Further, heights of the plurality of the movable side protruded parts 152*a* are substantially the same as each other. Further, the movable side protruded parts 152*a* are formed in the same shape as each other except the movable side protruded parts 152*a* which are disposed at both ends in the axial direction of the leveling roll. A width of the movable side protruded part 152*a* which is disposed at both ends in the axial direction of the leveling roll is set to be narrower than a width of other movable side protruded parts 152*a* in the axial direction of the leveling roll. A tip end (lower end) of the movable side protruded part 152*a* is formed in a flat-like face which is substantially perpendicular to the upper and lower direction. The tip end of the movable side protruded part 152*a* is a movable side abutting face 152*b*.

The cylinder 154 is disposed at both end sides in the axial direction of the lower leveling rolls 9, 10, 12 and 13. A rod of the cylinder 154 is, as shown in FIG. 13, connected with respective both end sides of the shaft support frames 140 and 141 in the axial direction of the leveling roll. Further, a main body of the cylinder 154 is fixed to the lower roll carriage 144 so that the rod is protruded toward the upper direction.

In this embodiment, when the lower leveling rolls 9, 10, 12 and 13 are located on the pass line "PL" side, as shown in FIG. 13, the fixed side abutting faces 151*b* and the movable side abutting faces 152*b* are abutted with each other. Further, when the lower leveling rolls 9, 10, 12 and 13 are to be retracted from the pass line "PL", as shown in FIG. 15, the movable side recessed-and-protruded member 152 is moved in the axial direction of the leveling roll by the power of the cylinder 153. As a result, the movable side protruded parts 152*a* are moved between the fixed side protruded parts 151*a* and the fixed side protruded parts 151*a* are moved between the movable side protruded parts 152*a*. Further, the lower leveling rolls 9, 10, 12 and 13 are retracted from the pass line "PL" by their own weights while keeping balance with pushing-up forces of the cylinders 154. In other words, when the lower leveling rolls 9, 10, 12 and 13 have been retracted from the pass line "PL", the movable side protruded parts 152*a* are disposed between the fixed side protruded parts 151*a* and the fixed side protruded parts 151*a* are disposed between the movable side protruded parts 152*a*.

Principal Effects in Second Embodiment

As described above, in the second embodiment, when the upper leveling rolls 5 and 6 are located on the pass line "PL" side, the fixed side abutting faces 147*b* and the movable side abutting faces 148*b* which are formed in flat-like faces that are substantially perpendicular to the upper and lower direction are abutted with each other. Further, when the lower leveling rolls 9, 10, 12 and 13 are located on the pass line "PL" side, the fixed side abutting faces 151*b* and the movable side abutting faces 152*b* which are formed in flat-like faces that are substantially perpendicular to the upper and lower direction are abutted with each other. In other words, when a steel plate is to be flattened, the fixed side abutting faces 147*b* and the movable side abutting faces 148*b* are abutted with each other and the fixed side abutting faces 151*b* and the movable side abutting faces 152*b* are abutted with each other. Therefore, at the time of flattening a steel plate, when flattening reaction forces having the same magnitude are acted on the plurality of the fixed side protruded parts 147*a* and the movable side protruded parts 148*a* whose heights in the upper and lower direction are substantially the same as each other, deformed quantities of the plurality of the fixed side protruded parts 147*a* and the movable side protruded parts 148*a* can be made substantially constant at the time of flattening the steel plate. Further, at the time of flattening a steel plate, when flattening reaction forces having the same magnitude are acted on the plurality of the fixed side protruded parts 151*a* and the movable side protruded parts 152*a*, deformed quantities of the plurality of the fixed side protruded parts 151*a* and the movable side protruded parts 152*a* can be made substantially constant at the time of flattening the steel plate.

Therefore, in this embodiment, variation of deformed quantities of the plurality of the fixed side protruded parts 147*a* and 151*a* and the movable side protruded parts 148*a* and 152*a* can be restrained at the time of flattening a steel plate. In other words, in this embodiment, variation of deformed quantities in the axial direction of the leveling roll of the member on which flattening reaction forces are acted can be restrained. As a result, in this embodiment, even when the upper leveling rolls 5 and 6 and the lower leveling rolls 9, 10, 12 and 13 are capable of being retracted from the pass line "PL", variation of a gap space between the leveling rolls in the upper and lower direction can be restrained in the axial direction of the leveling roll when a steel plate is flattened. Especially, in this embodiment, on both sides in the upper and lower direction of the pass line "PL", variation of deformed quantities of the members on which flattening reaction forces are acted can be restrained in the axial direction of the leveling roll. Therefore, when a steel plate is flattened, variation of the gap space between the leveling rolls in the upper and lower direction can be restrained effectively in the axial direction of the leveling roll.

In this embodiment, when viewed in the carrying direction, the fixed side protruded parts 147*a* are arranged so as to overlap with the shaft support parts 136*a* in the upper and lower direction. Therefore, flattening reaction forces which are acted on the backup rolls 17 and 18 are easily and directly applied to the plurality of the fixed side protruded parts 147*a* and the movable side protruded parts 148*a*. Especially, in this embodiment, the fixed side protruded parts 147*a* and the shaft support parts 136*a* are arranged with the same pitch "P6" in the axial direction of the leveling roll. Therefore, the flattening reaction forces acting on the backup rolls 17 and 18 are directly applied to the plurality of the fixed side protruded parts 147*a* and the movable side protruded parts 148*a*. Accordingly, in this embodiment, deformation of the shaft support frame 136, the movable side recessed-and-protruded member 148 and the like can be restrained when flattening reaction forces are acted on the backup rolls 17 and 18.

Similarly, in this embodiment, when viewed in the carrying direction, the fixed side protruded parts 151*a* are arranged so as to overlap with the shaft support parts formed in the shaft support frame 141 and the shaft support parts 140*a* in the upper and lower direction and, in addition, the shaft support parts formed in the shaft support frame 141 and the shaft support parts 140*a* and the fixed side protruded parts 151*a* are arranged with the same pitch "P6" as each other in the axial direction of the leveling roll. Therefore, the flattening reaction forces acted on the backup rolls 21, 22, 24 and 25 are directly applied to the plurality of the fixed side protruded parts 151*a* and the movable side protruded parts 152*a*. Accordingly, in this embodiment, deformation of the shaft support frames 140 and 141, the movable side recessed-and-protruded member 152 and the like can be restrained when flattening reaction forces are acted on the backup rolls 21, 22, 24 and 25.

Modified Examples of Second Embodiment

In the second embodiment, the first retract mechanism 129 is structured of the fixed side recessed-and-protruded member 147, the movable side recessed-and-protruded member 148 and the cylinders 149 and 150, and the second retract mechanisms 130 and 131 are structured of the fixed side recessed-and-protruded members 151, the movable side recessed-and-protruded members 152 and the cylinders 153 and 154. However, one of the first retract mechanism 129 and the second retract mechanisms 130 and 131 may be structured, similarly to the first embodiment, of a fixed side wedge and a movable side wedge.

In the second embodiment, the fixed side protruded parts 147*a* and the shaft support parts 136*a* are arranged with the same pitch "P6" as each other in the axial direction of the leveling roll. However, for example, it may be structured that the fixed side protruded parts 147*a* are arranged with a half pitch of the pitch "P6" and the shaft support parts 136*a* are arranged with the pitch "P6". In this case, the movable side protruded parts 148*a* are, for example, arranged with a half pitch of the pitch "P6". Similarly, for example, it may be structured that the fixed side protruded parts 151*a* are arranged with a half pitch of the pitch "P6" and the shaft support parts formed in the shaft support frame 141 and the shaft support parts 140*a* are arranged with the pitch "P6". In this case, the movable side protruded parts 152*a* are, for example, arranged with a half pitch of the pitch "P6".

In the second embodiment, the fixed side protruded parts 147*a* and 151*a* and the movable side protruded parts 148*a* and 152*a* are formed in a rectangular shape when viewed in the carrying direction. However, the fixed side protruded parts 147*a* and 151*a* and/or the movable side protruded parts 148*a* and 152*a* may be, for example, formed in a square shape or in a trapezoid shape when viewed in the carrying direction.

In the second embodiment, the fixed side recessed-and-protruded member 147 is disposed on the upper side and the movable side recessed-and-protruded member 148 is disposed on the lower side. However, the fixed side recessed-and-protruded member 147 may be disposed on the lower side and the movable side recessed-and-protruded member 148 may be disposed on the upper side. In this case, the fixed side recessed-and-protruded member 147 is, for example, formed in the shaft support frame 136. Similarly, in the second embodiment, the fixed side recessed-and-protruded member 151 is disposed on the lower side and the movable side recessed-and-protruded member 152 is disposed on the upper side. However, the fixed side recessed-and-protruded member 151 may be disposed on the upper side and the movable side recessed-and-protruded member 152 may be disposed on the lower side. In this case, the fixed side recessed-and-protruded member 151 is, for example, formed in the shaft support frames 140 and 141.

In the second embodiment, the cylinders 149 and 153 are connected with the movable side recessed-and-protruded members 148 and 152. However, a drive source such as a motor may be connected with the movable side recessed-and-protruded members 148 and 152. In other words, a moving mechanism for moving the movable side recessed-and-protruded members 148 and 152 may be structured of another drive source such as a motor.

In the second embodiment, the backup rolls 16 through 26 are rotatably held by the fixed shafts 132, but the backup rolls 16 through 26 may be fixed to rotation shafts. In this case, both end sides of the rotation shafts are rotatably supported by shaft support parts of the shaft support frames 134 through 141.

In the second embodiment, four pieces of the upper leveling rolls 4 through 7 and seven pieces of the lower leveling rolls 8 through 14 are arranged. However, the number of the upper leveling rolls to be arranged is not limited to four and the number of the lower leveling rolls to be arranged is not limited to seven. For example, four pieces of upper leveling rolls 4 through 7 and only five pieces of lower leveling rolls 9 through 13 which are disposed in a zigzag manner with respect to the upper leveling rolls 4 through 7 may be arranged. Further, the number of the upper leveling rolls to be arranged may be larger than the number of the lower leveling rolls.

Technical Ideas Grasped from Second Embodiment

Technical ideas which may be grasped from the second embodiment will be described below.

(1) A roller leveler in which a steel plate is flattened while being carried, comprising:

plural pieces of leveling rolls which are arranged with a predetermined pitch in a carrying direction of the steel plate; and a retract mechanism which makes some of the leveling rolls retract from a pass line where the steel plate is passed, for changing a pitch of the leveling rolls which are used for flattening the steel plate;

wherein the retract mechanism is provided with a fixed side recessed-and-protruded member having a plurality of fixing side protruded parts arranged with a predetermined first pitch in an axial direction of the leveling roll, a movable side recessed-and-protruded member having a plurality of movable side protruded parts arranged with the first pitch in the axial direction of the leveling roll, and a moving mechanism for moving the movable side recessed-and-protruded member in the axial direction of the leveling roll;

wherein tip ends of the fixed side protruded parts are formed in a fixed side abutting face having a flat-like face which is substantially perpendicular to an upper and lower direction, and tip ends of the movable side protruded parts are formed in a movable side abutting face having a flat-like face which is substantially perpendicular to the upper and lower direction; and wherein when the leveling rolls are located on the pass line side, the fixed side abutting faces and the movable side abutting faces are abutted with each other and, when the leveling rolls are retracted from the pass line, the movable side recessed-and-protruded member is moved in the axial direction of the leveling roll so that the movable side protruded parts are disposed between the fixed side protruded parts and the fixed side protruded parts are disposed between the movable side protruded parts.

In the roller leveler described in the above-mentioned U.S. Pat. No. 5,412,968, the fixed side wedge which is fixed to the upper face or the under face of the holding member holding the backup rolls is formed in a rectangular triangle shape when viewed in the carrying direction of the steel plate. Further, the movable side wedge abutting with the fixed side wedge is also formed in a rectangular triangle shape when viewed in the carrying direction of the steel plate. In other words, a thickness of the fixed side wedge and a thickness of the movable side wedge are not constant in the axial direction of the leveling roll.

Therefore, in this roller leveler, in a case that reaction forces at the time of flattening a steel plate are acted on plural pieces of backup rolls which are held by the holding member, even when the reaction forces acting on the respective backup rolls are the same as each other, the deformed quantity of the fixed side wedge may be varied in the axial direction of the leveling roll. Similarly, in a case that reaction forces at the time of flattening the steel plate are acted on plural pieces of backup rolls which are held by the holding member, even when the reaction forces acting on the respective backup rolls are the same as each other, the deformed quantity of the movable side wedge may be varied in the axial direction of the leveling roll. In other words, in this roller leveler, even when the reaction force at the time of flattening the steel plate is uniformly acted in the axial direction of the leveling roll, the deformed quantity of the member subjected to the reaction force at the time of flattening may be varied in the axial direction of the leveling roll. Therefore, in this roller leveler, a gap space between the upper leveling rolls and the lower leveling rolls in the upper and lower direction at the time of flattening the steel plate may be largely varied in the axial direction of the leveling roll and, as a result, the steel plate may not be adequately flattened.

However, in the roller leveler described in the above-mentioned (1), the retract mechanism is provided with the fixed side recessed-and-protruded member having a plurality of fixed side protruded parts, which are arranged with a first pitch in the axial direction of the leveling roll, and the movable side recessed-and-protruded member having a plurality of movable side protruded parts which are arranged with the first pitch in the axial direction of the leveling roll. Further, in this roller leveler, when the leveling rolls are located on the pass line side, the fixed side abutting faces of the fixed side protruded parts formed in a flat-like shape which is substantially perpendicular to the upper and lower direction and the movable side abutting faces of the movable side protruded parts formed in a flat-like shape which is substantially perpendicular to the upper and lower direction are abutted with each other. In other words, when a steel plate is flattened, the fixed side abutting faces and the movable side abutting faces which are formed in a flat-like shape substantially perpendicular to the upper and lower direction are abutted with each other.

Therefore, when the plurality of the fixed side protruded parts and the movable side protruded parts, which are arranged with the first pitch in the axial direction of the leveling roll, are subjected to the flattening reaction forces having the same magnitude at the time of flattening a steel plate, deformed quantities of the plurality of the fixed side protruded parts and the movable side protruded parts are capable of being made substantially constant at the time of flattening the steel plate. Accordingly, variation of the deformed quantities of the plurality of fixed side protruded parts and the movable side protruded parts can be restrained when a steel plate is flattened. In other words, variation of deformed quantity of a member on which the flattening reaction force is acted can be restrained in the axial direction of the leveling roll. As a result, in this roller leveler, even when some of the leveling rolls are capable of being retracted from the pass line where a steel plate is passed, variation of a gap space between the leveling rolls in the upper and lower direction can be restrained in the axial direction of the leveling roll at the time of flattening the steel plate.

(2) The roller leveler described in the above-mentioned (1), further comprising plural pieces of backup rolls for restraining deflections of the leveling rolls, and a plurality of shaft support parts which supports both end sides of a fixed shaft rotatably holding the backup roll or which supports both end sides of a rotation shaft rotating together with the backup roll, wherein the shaft support parts are disposed so as to overlap with the fixed side protruded parts in the upper and lower direction when viewed in the carrying direction of the steel plate.

In the roller leveler described in the above-mentioned (2), flattening reaction forces acted on the backup rolls are easily and directly applied to the plurality of the fixed side protruded parts and the movable side protruded parts. Therefore, deformation of the fixed side recessed-and-protruded member, the movable side recessed-and-protruded member and the like can be restrained when flattening reaction force is acted on the backup roll.

(3) The roller leveler described in the above-mentioned (2), wherein the plural pieces of the backup rolls are arranged with the first pitch in the axial direction of the leveling roll, and the plurality of the shaft support parts are arranged with the first pitch in the axial direction of the leveling roll.

In the roller leveler described in the above-mentioned (3), flattening reaction forces acted on the backup rolls are directly applied to the plurality of the fixed side protruded parts and the movable side protruded parts. Therefore, deformation of the fixed side recessed-and-protruded member, the movable side recessed-and-protruded member and the like can be effectively restrained when the flattening reaction force is acted on the backup rolls.

(4) The roller leveler described in the above-mentioned (1) through (3), wherein the plural pieces of the leveling rolls include plural pieces of first leveling rolls which are arranged with a predetermined pitch in the carrying direction of the steel plate and which are disposed on one side in the upper and lower direction, and plural pieces of second leveling rolls which are arranged with a predetermined pitch in the carrying direction of the steel plate and which are disposed on the other side in the upper and lower direction, and the retract mechanism includes a first retract mechanism which makes some of the first leveling rolls retract from the pass line for changing a pitch of the first leveling rolls which are used for flattening the steel plate, and a second retract mechanism which makes some of the second leveling rolls retract from the pass line for changing a pitch of the second leveling rolls which are used for flattening the steel plate.

In the roller leveler described in the above-mentioned (4), variation of deformed quantity of the members on both sides in the upper and lower direction on which flattening reaction forces are acted can be restrained in the axial direction of the leveling roll. Therefore, variation of a gap space between the leveling rolls in the upper and lower direction when a steel plate is flattened can be effectively restrained in the axial direction of the leveling roll.

What is claimed is:

1. A roller leveler in which a steel plate is flattened while being carried, comprising:

a plurality of leveling rolls which are arranged with a predetermined pitch in a carrying direction of the steel plate;

a retract mechanism configured to make part of the leveling rolls retract from a pass line where the steel plate is passed, for changing a roll pitch of the leveling rolls which are used for flattening the steel plate;

a plurality of backup rolls configured to restrain deflections of the leveling rolls; and a plurality of shaft support parts, each of which supports both end sides of a fixed shaft rotatably holding a corresponding one of the backup rolls or supports both end sides of a rotation shaft rotating together with a corresponding one of the backup rolls, wherein the retract mechanism is provided with a fixed side recessed-and-protruded member having a plurality of fixing side protruded parts arranged with a first pitch in an axial direction of the leveling roll, a movable side recessed-and-protruded member having a plurality of movable side protruded parts arranged with the first pitch in the axial direction of the leveling roll, and a moving mechanism configured to move the movable side recessed-and-protruded member in the axial direction of the leveling roll, wherein tip ends of the fixed side protruded parts are formed in a fixed side abutting face having a flat-shaped face which is substantially perpendicular to an upper and lower direction, and tip ends of the movable side protruded parts are formed in a movable side abutting face having a flat-shaped face which is substantially perpendicular to the upper and lower direction, wherein the shaft support parts are disposed so as to overlap with the fixed side protruded parts in the upper and lower direction when viewed in the carrying direction of the steel plate, and wherein when the part of the leveling rolls are located on the pass line side, the fixed side abutting faces and the movable side abutting faces are abutted with each other and, when the part of the leveling rolls are retracted from the pass line, the movable side recessed-and-protruded member is moved in the axial direction of the leveling roll so that the movable side protruded parts are disposed between the fixed side protruded parts and the fixed side protruded parts are disposed between the movable side protruded parts.

2. The roller leveler according to claim 1, wherein the plurality of backup rolls are arranged with the first pitch in the axial direction of the leveling roll, and the plurality of the shaft support parts are arranged with the first pitch in the axial direction of the leveling roll.

3. The roller leveler according to claim 1, wherein the plurality of leveling rolls include a plurality of first leveling rolls which are arranged with the predetermined pitch in the carrying direction of the steel plate and which are disposed on one side of the pass line in the upper and lower direction, and a plurality of second leveling rolls which are arranged with the predetermined pitch in the carrying direction of the steel plate and which are disposed on the other side of the pass line in the upper and lower direction, and the retract mechanism includes a first retract mechanism configured to make part of the first leveling rolls retract from the pass line for changing the roll pitch of the first leveling rolls which are used for flattening the steel plate, and a second retract mechanism configured to make part of the second leveling rolls retract from the pass line for changing the roll pitch of the second leveling rolls which are used for flattening the steel plate.

4. The roller leveler according to claim 3, wherein a number of the first leveling rolls is "4+3k", wherein "k" is an integer of 0 or more, a number of the second leveling rolls is "5+3k" and the second leveling rolls are disposed in a zigzag manner with respect to the first leveling rolls, the first retract mechanism is configured to make two adjacent first leveling rolls retract from the pass line for changing a number and the roll pitch of the first leveling rolls which are used for flattening the steel plate, the second retract mechanism is configured to make at least two pairs of two adjacent second leveling rolls retract from the pass line for changing a number and the roll pitch of the second leveling rolls which are used for flattening the steel plate, one of the second leveling rolls which is interposed between the at least two pairs of the adjacent second leveling rolls is configured not to be retracted from the pass line for changing the number and the roll pitch of the second leveling rolls which are used for flattening the steel plate, and the roller leveler further comprises third leveling rolls which are disposed on each of an upstream side and a downstream side of the second leveling rolls in the carrying direction of the steel plate, which is disposed with the predetermined pitch with respect to the second leveling rolls in the carrying direction of the steel plate.

* * * * *